US008257891B2

(12) United States Patent
Nakatake et al.

(10) Patent No.: US 8,257,891 B2
(45) Date of Patent: Sep. 4, 2012

(54) ELECTROPHOTOGRAPHIC PHOTOCONDUCTOR, PROCESS CARTRIDGE AND IMAGE FORMING APPARATUS

(75) Inventors: Naoki Nakatake, Kobe (JP); Atsushi Takehara, Kyoto (JP); Toshihiko Koizumi, Kofu (JP); Tsuyoshi Ueda, Kofu (JP); Tadayoshi Uchida, Kofu (JP); Hajime Suzuki, Kofu (JP)

(73) Assignee: Ricoh Company, Ltd., Tokyo (JP)

( * ) Notice: Subject to any disclaimer, the term of this patent is extended or adjusted under 35 U.S.C. 154(b) by 262 days.

(21) Appl. No.: 12/684,545

(22) Filed: Jan. 8, 2010

(65) Prior Publication Data

US 2010/0178074 A1 Jul. 15, 2010

(30) Foreign Application Priority Data

Jan. 13, 2009 (JP) ..... 2009-004771

(51) Int. Cl.
*G03G 5/06* (2006.01)

(52) U.S. Cl. ..... 430/59.6; 430/58.05; 430/58.65; 430/58.75; 430/58.85; 399/159

(58) Field of Classification Search ..... 430/58.05, 430/58.65, 58.75, 58.85, 59.6; 399/159
See application file for complete search history.

(56) References Cited

U.S. PATENT DOCUMENTS

2004/0142261 A1* 7/2004 Kiuchi et al. ..... 430/70
2004/0214100 A1* 10/2004 Yu et al. ..... 430/58.8

(Continued)

FOREIGN PATENT DOCUMENTS

JP 58-163946 9/1983

(Continued)

OTHER PUBLICATIONS

Diamond, "Handbook of Imaging Materials," Marcel Dekker, NY, NY 1991. p. 379-380.*

*Primary Examiner* — Peter Vajda
(74) *Attorney, Agent, or Firm* — Cooper & Dunham LLP

(57) ABSTRACT

To provide an electrophotographic photoconductor including: a substrate; a charge generating layer; and a charge transporting layer, the charge generating layer and the charge transporting layer being disposed over the substrate, wherein the charge transporting layer contains a charge transporting material represented by General Formula (I) below and an additive represented by General Formula (II) below:

General Formula (I)

where $R^1$, $R^2$ and $R^3$ each independently denote any one of a hydrogen atom, a halogen atom, an alkyl group which may contain a substituent, and an alkoxy group which may contain a substituent, General Formula (II)

where $R^4$ and $R^5$ each denote a tertiary butyl group, and $R^6$ and $R^7$ each independently denote one of an alkyl group which may contain a substituent, and an aryl group which may contain a substituent.

17 Claims, 6 Drawing Sheets

U.S. PATENT DOCUMENTS

2009/0136260 A1 5/2009 Ikegami et al.

FOREIGN PATENT DOCUMENTS

| | | | |
|---|---|---|---|
| JP | 10-48856 | | 2/1998 |
| JP | 11-184108 | | 7/1999 |
| JP | 2000-081757 | * | 3/2000 |
| JP | 2002-351106 | | 12/2002 |
| JP | 3689546 | | 6/2005 |
| JP | 2007-271962 | | 10/2007 |
| JP | 2008-250149 | * | 10/2008 |

* cited by examiner

ELECTROPHOTOGRAPHIC PHOTOCONDUCTOR, PROCESS CARTRIDGE AND IMAGE FORMING APPARATUS

BACKGROUND OF THE INVENTION

1. Field of the Invention

The present invention relates to an electrophotographic photoconductor superbly resistant to natural light and short-wavelength light, used in an electrophotographic printer, copier, etc.; a process cartridge using the electrophotographic photoconductor; and an image forming apparatus using the electrophotographic photoconductor.

2. Description of the Related Art

For an electrophotographic photoconductor (hereinafter also referred to simply as "photoconductor"), a function of maintaining surface charge in a dark place, a function of receiving light and generating charge and a function of receiving light and transporting charge are necessary. Electrophotographic photoconductors are broadly classified into so-called single-layer photoconductors in which these functions are performed by one layer, and so-called functionally divided laminated photoconductors in which a layer mainly contributing to charge generation and a layer mainly contributing to maintenance of surface charge in a dark place and charge transfer upon receipt of light are formed one on top of the other in a functionally divided manner.

To electrophotographic image formation performed using these photoconductors, the Carlson method is applied, for example. In the Carlson method, image formation is as follows: a photoconductor is charged in a dark place by means of corona discharge, a latent electrostatic image based upon a letter/character, a drawing, etc. in a document is formed on the surface of the charged photoconductor, the formed latent electrostatic image is developed with toner, and the developed toner image is transferred and fixed onto a support such as paper. After the transfer of the toner image, the photoconductor is subjected to charge elimination, removal of residual toner, charge elimination by light, etc. and then reused. In recent years, along with the advancement of digitalization in electrophotographic processes, exposure with lasers whose input wavelengths to photoconductors are in the near-infrared range or with LEDs has been utilized not only in the field of printers but also in the field of copiers.

Also regarding photoconductors, electrophotographic photoconductors using organic materials have been put to practical use because they are advantageous in term of flexibility, thermal stability, layer formability and so forth. These days, functionally divided laminated photoconductors are very popular, each of which includes a photosensitive layer composed of a charge generating layer containing a charge generating agent and of a charge transporting layer containing a charge transporting material. In particular, negatively charged photoconductors are very frequently proposed, each of which includes as a charge generating layer a layer obtained by dispersing an organic pigment as a charge generating agent into a vapor-deposited layer or a resin and also includes as a charge transporting layer a layer obtained by dispersing an organic low-molecular compound as a charge transporting material into a resin.

Organic materials have advantages which inorganic materials do not have in many respects; nonetheless, organic materials which can sufficiently satisfy all properties required for an electrophotographic photoconductor have yet to be obtained. Specifically, degradation of image quality is caused by a decrease in charge potential, an increase in residual potential, change in sensitivity and the like which are due to repeated use. Although not all causes of the degradation have been ascertained, one major cause is the light resistance of a photoconductor. Generally, a photoconductor is stably resistant to near-infrared light used for exposure, etc. It should, however, be noted that when a paper jam occurs in a machine or maintenance including replacement of parts, etc. takes place, the photoconductor will be exposed to outside light. This outside light will be far greater in quantity than the light applied inside the machine and include a great deal of short-wavelength light which can damage the photoconductor. The photoconductor thus exposed to the outside light presents such problems as a decrease in charge potential and an increase in residual potential. To protect the photoconductor from the damage done by the outside light, a yellow fluorescent lamp with reduced short-wavelength light is used when the machine is assembled.

As for photoconductors themselves, addition of an ultraviolet absorber and/or an antioxidant to a photosensitive layer, addition of a compound having a maximum light absorption wavelength in the range of 380 nm to 480 nm to a photosensitive layer, and so forth have been proposed (refer to Japanese Patent Application Laid-Open (JP-A) Nos. 58-163946, 10-048856 and 11-184108).

However, these proposals are problematic in that the added compounds themselves cause a reduction in charge potential and an increase in residual potential.

JP-A No. 2007-271962 proposes a stable single-layer electrophotographic photoconductor which is highly sensitive and can withstand temporal degradation, obtained by combining a specific electron transfer material with a specific hole transfer material made of oxytitanium phthalocyanine. In this proposal, however, neither use of an electron transfer material as a light-resistant agent nor a way of doing so is disclosed or suggested, and there is such a problem that sufficient resistance to light cannot be yielded because the photoconductor has a single layer structure.

Accordingly, in reality, swift provision of the following is hoped for: an electrophotographic photoconductor which can adapt to reduction in the diameter of the photoconductor and a process with high circumferential speed, caused by miniaturization and/or increase in the speed of an image forming apparatus, and which is superior in light resistance; a process cartridge using the electrophotographic photoconductor; and an image forming apparatus using the electrophotographic photoconductor.

BRIEF SUMMARY OF THE INVENTION

An object of the present invention is to provide an electrophotographic photoconductor which can adapt to reduction in the diameter of the photoconductor and a process with high circumferential speed, caused by miniaturization and/or increase in the speed of an image forming apparatus, and which is superior in light resistance; a process cartridge using the electrophotographic photoconductor; and an image forming apparatus using the electrophotographic photoconductor.

Means for solving the problems are as follows.

<1> An electrophotographic photoconductor including: a substrate; a charge generating layer; and a charge transporting layer, the charge generating layer and the charge transporting layer being disposed over the substrate, wherein the charge transporting layer contains a charge transporting material represented by General Formula (I) below and an additive represented by General Formula (II) below:

General Formula (I)

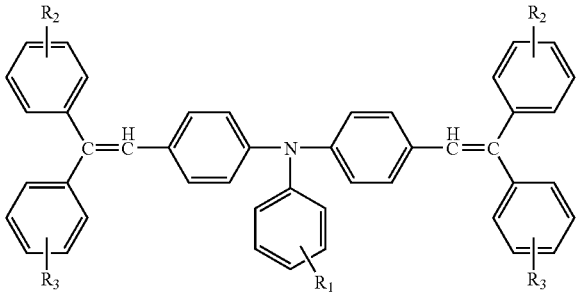

where $R^1$, $R^2$ and $R^3$ each independently denote any one of a hydrogen atom, a halogen atom, an alkyl group which may contain a substituent, and an alkoxy group which may contain a substituent, General Formula (II)

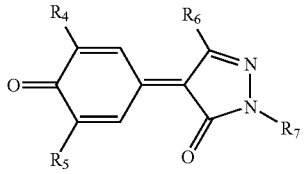

where $R^4$ and $R^6$ each denote a tertiary butyl group, and $R^6$ and $R^7$ each independently denote one of an alkyl group which may contain a substituent, and an aryl group which may contain a substituent.

<2> The electrophotographic photoconductor according to <1>, wherein the additive represented by General Formula (II) has a maximum absorption wavelength in the range of 300 nm to 370 nm and does not have an absorption wavelength in the range of 730 nm to 800 nm.

<3> The electrophotographic photoconductor according to <1>, wherein the charge transporting material represented by General Formula (I) includes the compound represented by Structural Formula (Ia) below:

Structural Formula (Ia)

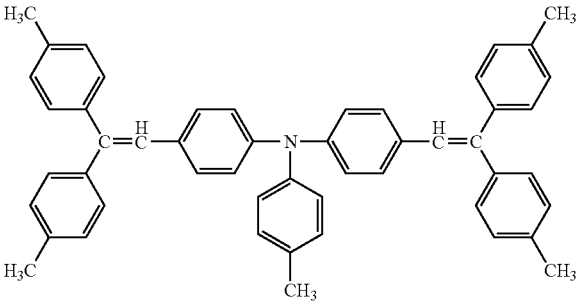

<4> The electrophotographic photoconductor according to <1>, wherein the charge transporting material represented by General Formula (I) includes the compound represented by Structural Formula (Ib) below:

Structural Formula (Ib)

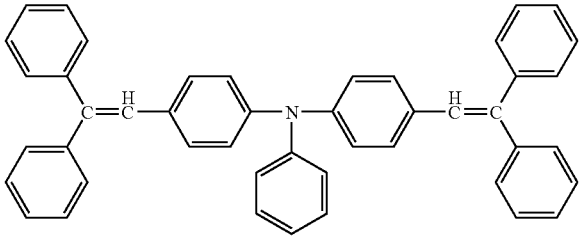

<5> The electrophotographic photoconductor according to <1>, wherein the charge transporting material represented by General Formula (I) includes the compound represented by Structural Formula (Ic) below:

Structural Formula (Ic)

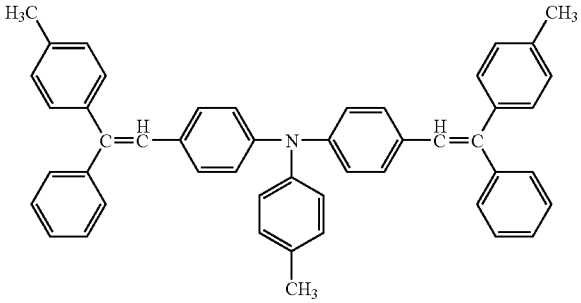

<6> The electrophotographic photoconductor according to <1>, wherein the charge transporting material represented by General Formula (I) includes the compound represented by Structural Formula (Id) below:

Structural Formula (Id)

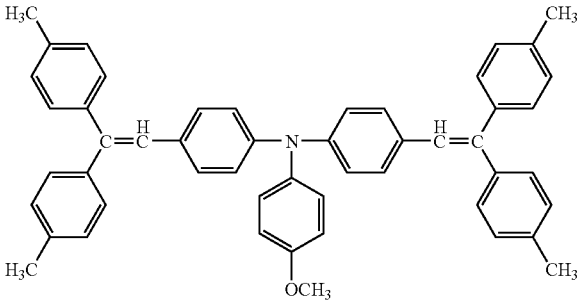

<7> The electrophotographic photoconductor according to <1>, wherein the charge transporting material represented by General Formula (I) includes the compound represented by Structural Formula (Ie) below:

Structural Formula (Ie)

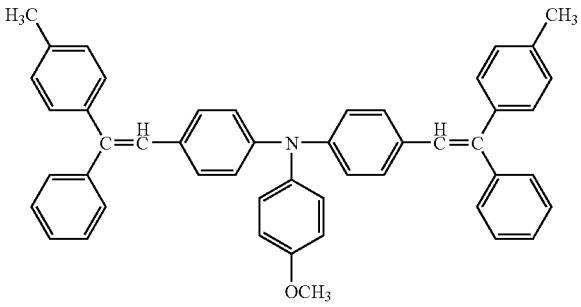

<8> The electrophotographic photoconductor according to <1>, wherein the additive represented by General Formula (II) includes the compound represented by Structural Formula (IIa) below:

Structural Formula (IIa)

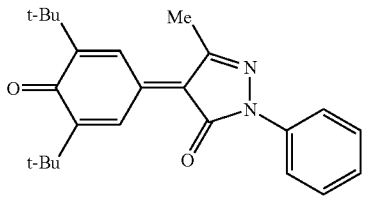

where t-Bu denotes a tertiary butyl group, and Me denotes a methyl group.

<9> The electrophotographic photoconductor according to <1>, wherein the additive represented by General Formula (II) includes the compound represented by Structural Formula (IIb) below:

Structural Formula (IIb)

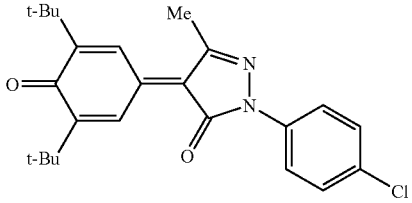

where t-Bu denotes a tertiary butyl group, and Me denotes a methyl group.

<10> The electrophotographic photoconductor according to <1>, wherein the additive represented by General Formula (II) includes the compound represented by Structural Formula (IIc) below:

Structural Formula (IIc)

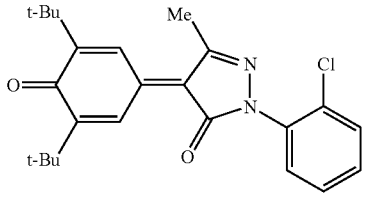

where t-Bu denotes a tertiary butyl group, and n-Pr denotes an n-propyl group.

<11> The electrophotographic photoconductor according to <1>, wherein the additive represented by General Formula (II) includes the compound represented by Structural Formula (IId) below:

Structural Formula (IId)

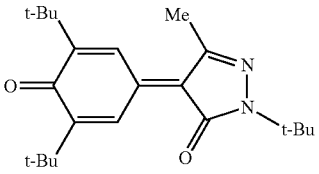

where t-Bu denotes a tertiary butyl group, and Me denotes a methyl group.

<12> The electrophotographic photoconductor according to <1>, wherein the additive represented by General Formula (II) includes the compound represented by Structural Formula (IIe) below:

Structural Formula (IIe)

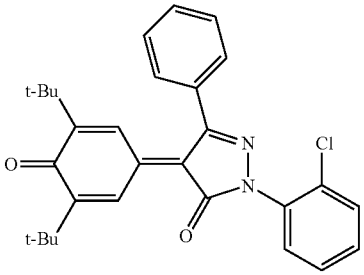

where t-Bu denotes a tertiary butyl group.

<13> The electrophotographic photoconductor according to <1>, wherein the additive represented by General Formula (II) includes the compound represented by Structural Formula (IIf) below:

Structural Formula (IIf)

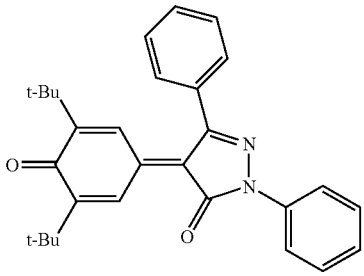

where t-Bu denotes a tertiary butyl group.

<14> The electrophotographic photoconductor according to <1>, wherein the charge transporting layer further contains a benzotriazole-based ultraviolet absorber.

<15> The electrophotographic photoconductor according to <1>, wherein the charge transporting layer further contains a phenolic antioxidant.

<16> The electrophotographic photoconductor according to <1>, wherein the charge transporting layer further contains two polycarbonate resins, and one of the polycarbonate resins is a compound represented by General Formula (III) below:

General Formula (III)

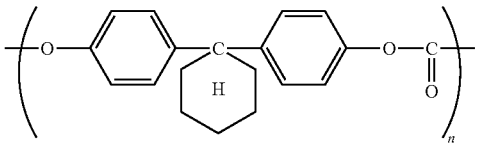

where n denotes the number of times the repeat unit is repeated such that the one of the polycarbonate resins has a viscosity average molecular weight of 20,000 to 50,000.

<17> A process cartridge detachably mountable to a main body of an image forming apparatus, including: an electrophotographic photoconductor; and a developing unit configured to develop a latent electrostatic image, formed on the electrophotographic photoconductor, with a toner so as to form a visible image, wherein the electrophotographic photoconductor includes a substrate, a charge generating layer and a charge transporting layer, the charge generating layer and the charge transporting layer being disposed over the substrate, and wherein the charge transporting layer contains a charge transporting material represented by General Formula (I) below and an additive represented by General Formula (II) below:

General Formula (I)

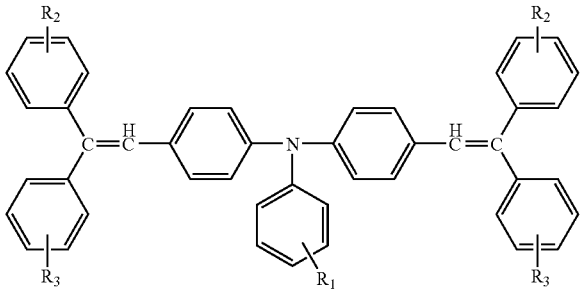

where $R^1$, $R^2$ and $R^3$ each independently denote any one of a hydrogen atom, a halogen atom, an alkyl group which may contain a substituent, and an alkoxy group which may contain a substituent, General Formula (II)

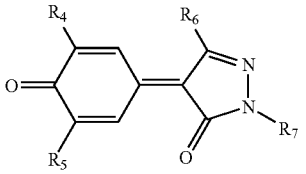

where $R^4$ and $R^5$ each denote a tertiary butyl group, and $R^6$ and $R^7$ each independently denote one of an alkyl group which may contain a substituent, and an aryl group which may contain a substituent.

<18> An image forming apparatus including: an electrophotographic photoconductor; a latent electrostatic image forming unit configured to form a latent electrostatic image on the electrophotographic photoconductor; a developing unit configured to develop the latent electrostatic image with a toner so as to form a visible image; a transfer unit configured to transfer the visible image onto a recording medium; and a fixing unit configured to fix the visible image transferred onto the recording medium, wherein the electrophotographic photoconductor includes a substrate, a charge generating layer and a charge transporting layer, the charge generating layer and the charge transporting layer being disposed over the substrate, and wherein the charge transporting layer contains a charge transporting material represented by General Formula (I) below and an additive represented by General Formula (II) below:

General Formula (I)

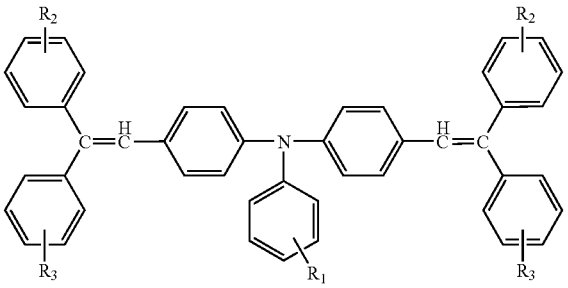

where $R^1$, $R^2$ and $R^3$ each independently denote any one of a hydrogen atom, a halogen atom, an alkyl group which may contain a substituent, and an alkoxy group which may contain a substituent, General Formula (II)

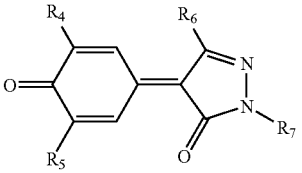

where $R^4$ and $R^5$ each denote a tertiary butyl group, and $R^6$ and $R^7$ each independently denote one of an alkyl group which may contain a substituent, and an aryl group which may contain a substituent.

According to the present invention, it is possible to solve the problems in related art and provide an electrophotographic photoconductor which can adapt to reduction in the diameter of the photoconductor and a process with high circumferential speed, caused by miniaturization and/or increase in the speed of an image forming apparatus, and which is superior in light resistance; a process cartridge using the electrophotographic photoconductor; and an image forming apparatus using the electrophotographic photoconductor.

DETAILED DESCRIPTION OF THE INVENTION

Electrophotographic Photoconductor

An electrophotographic photoconductor of the present invention includes a substrate, a charge generating layer and a charge transporting layer, the charge generating layer and the charge transporting layer being disposed over the substrate. Further, the electrophotographic photoconductor includes other layer(s) if necessary.

—Layer Structure—

The layer structure of the electrophotographic photoconductor is not particularly limited and may be suitably selected according to the purpose. A first embodiment of the electrophotographic photoconductor includes a substrate and, on the substrate, a photosensitive layer having a single-layer structure (hereinafter also referred to as "single-layer photosensitive layer") and, if necessary, includes other layer(s). Meanwhile, a second embodiment of the electrophotographic photoconductor includes a substrate and, on the substrate, a photosensitive layer having a laminated structure, formed by laying a charge generating layer and a charge transporting layer one on top of the other (hereinafter also referred to as "laminated photosensitive layer") and, if necessary, includes other layer(s). Note that, in the second embodiment, the charge generating layer and the charge transporting layer may be laid in the opposite order. Among these, the electrophotographic photoconductor including the laminated photosensitive layer is particularly preferable.

Figure 1:
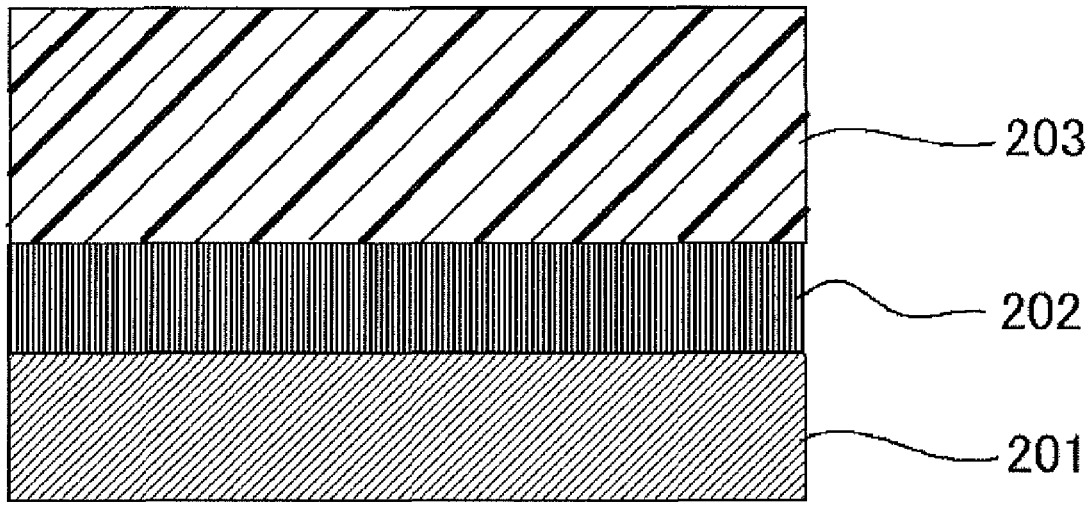
FIG. 1 is a schematic cross-sectional view showing an example of an electrophotographic photoconductor of the present invention.

Here, the electrophotographic photoconductor is explained with reference to the drawings. FIG. 1 is a schematic cross-sectional view showing an example of an electrophotographic photoconductor of the present invention.

In FIG. 1, a charge generating layer 202 containing a charge generating material, and a charge transporting layer 203 containing a specific charge transporting material and also containing a specific additive are formed over a substrate 201. In this case, the charge generating layer and the charge transporting layer constitute a photosensitive layer.

<Charge Transporting Layer>

The charge transporting layer includes a charge transporting material represented by General Formula (I) below and an additive represented by General Formula (II) below, preferably includes a binder resin and, if necessary, includes other component(s).

—Charge Transporting Material Represented by General Formula (I)—

General Formula (I)

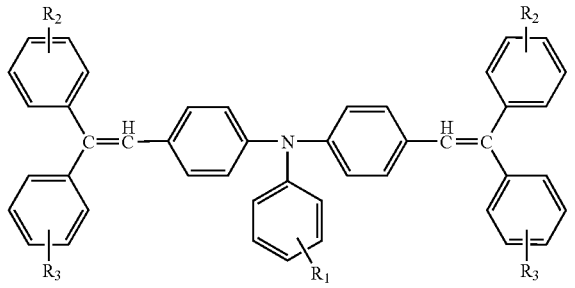

In General Formula (I), $R^1$, $R^2$ and $R^3$ each independently denote any one of a hydrogen atom, a halogen atom, an alkyl group which may contain a substituent, and an alkoxy group which may contain a substituent.

Examples of the halogen atom include fluorine atom, bromine atom and chlorine atom.

Examples of the alkyl group include methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group and isodecyl group.

Examples of the alkoxy group include methoxy group, ethoxy group and propoxy group.

The charge transporting material represented by General Formula (I) above is superior in responsiveness and makes it possible to provide an environmentally resistant electrophotographic photoconductor.

It is particularly desirable that the charge transporting material represented by General Formula (I) above be any one of the compounds represented by Structural Formulae (Ia) to (Ie) below, and selection of any of them makes it possible to provide an electrophotographic photoconductor superior in responsiveness.

Structural Formula (Ia)

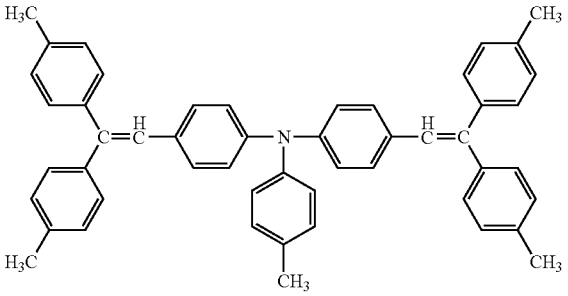

Structural Formula (Ib)

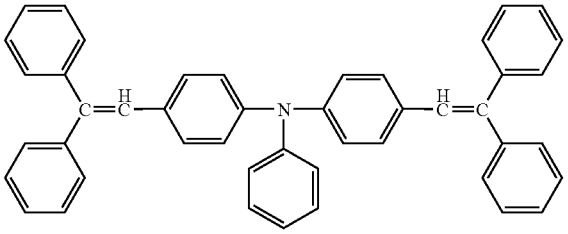

Structural Formula (Ic)

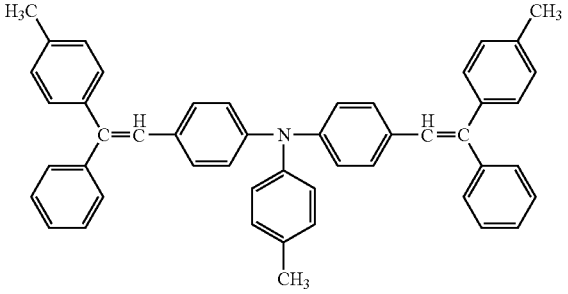

-continued

Structural Formula (Id)

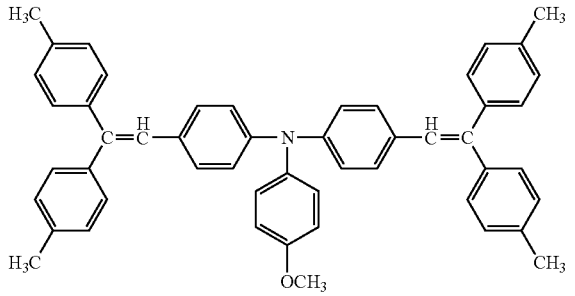

Structural Formula (Ie)

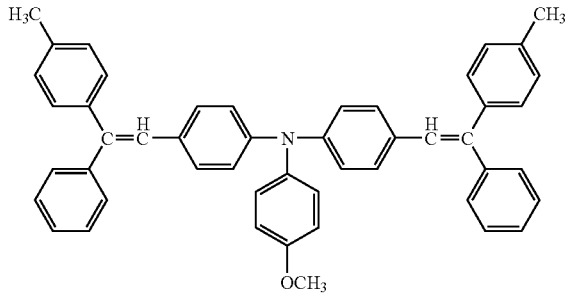

The amount of the charge transporting material represented by General Formula (I) contained in the charge transporting layer is preferably in the range of 0.3 parts by mass to 2.0 parts by mass with respect to 1 part by mass of the binder resin also contained therein. When the amount of the charge transporting material is less than 0.3 parts by mass with respect to 1 part by mass of the binder resin, there may be a degradation of electrical properties, for example an increase in residual potential. When the amount of the charge transporting material is greater than 2.0 parts by mass with respect to 1 part by mass of the binder resin, there may be a degradation of mechanical properties such as abrasion resistance.

The charge transporting material represented by General Formula (I) may be mixed with another charge transporting material. In this case, the mass ratio of the charge transporting material represented by General Formula (I) to the other charge transporting material is preferably in the range of 50:50 to 95:5, more preferably in the range of 70:30 to 95:5.

The other charge transporting material is not particularly limited and may be suitably selected according to the purpose, and it may, for example, be a high-molecular compound or a low-molecular compound.

Examples of the high-molecular compound include polyvinyl carbazole, halogenated polyvinyl carbazole, polyvinyl pyrene, polyvinyl indoloquinoxaline, polyvinyl benzothiophene, polyvinyl anthracene, polyvinyl acridine, polyvinyl pyrazoline, polyacetylene, polythiophene, polypyrrole, polyphenylene, polyphenylene vinylene, polyisothianaphthene, polyaniline, polydiacetylene, polyheptadiene, polypyridinediyl, polyquinoline, polyphenylene sulfide, polyferrocenylene, polyperinaphthylene and polyphthalocyanine.

Examples of the low-molecular compound include trinitrofluorenone, tetracyanoethylene, tetracyanoquinodimethane, quinone, diphenoquinone, naphthoquinone, anthraquinone, and derivatives of these compounds; polycyclic aromatic compounds such as anthracene, pyrene and phenanthrene; nitrogen-containing heterocyclic compounds such as indole, carbazole and imidazole; and compounds such as fluorenone, fluorene, oxadiazole, oxazole, pyrazoline, hydrazone, triphenylmethane, triphenylamine, enamine and stilbene.

Examples of the other charge transporting material also include high-molecular solid electrolytes obtained by doping high-molecular compounds such as polyethylene oxide, polypropylene oxide, polyacrylonitrile and polymethacrylic acid with metal ions such as Li ions. Examples of the other charge transporting material further include organic charge-transfer complexes formed from combinations of electron-donating compounds and electron-accepting compounds, such as tetrathiafulvalene-tetracyanoquinodimethane.

These may be used individually or in combination.

—Additive Represented by General Formula (II)—

General Formula (II)

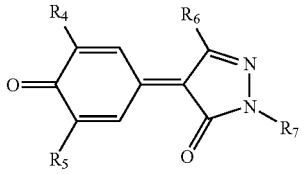

In General Formula (II), $R^4$ and $R^5$ each denote a tertiary butyl group, and $R^6$ and $R^7$ each independently denote one of an alkyl group which may contain a substituent, and an aryl group which may contain a substituent.

Examples of the alkyl group include methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group and isodecyl group.

Examples of the aryl group include phenyl group, tolyl group, xylyl group, biphenylyl group, naphthyl group, anthryl group and phenanthryl group.

The additive represented by General Formula (II) has a maximum absorption wavelength in the range of 300 nm to 370 nm and does not have an absorption wavelength in the range of 730 nm to 800 nm. Since the additive has a maximum absorption wavelength in the range of 300 nm to 370 nm, it is possible to protect the photoconductor from light exposure in the ultraviolet region. Also, since the additive does not have an absorption wavelength in the range of 730 nm to 800 nm, semiconductor laser exposure or LED exposure in the range of 740 nm to 780 nm is not hindered.

It is particularly desirable that the additive represented by General Formula (II) above be any one of the additives represented by Structural Formulae (IIa) to (IIf) below, and selection of any of them makes it possible to provide an electrophotographic photoconductor which is highly resistant to light and exhibits stable performance.

Structural Formula (IIa)

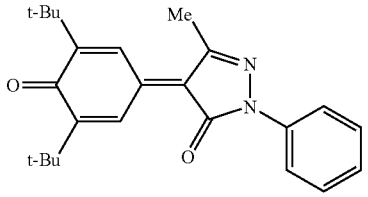

In Structural Formula (IIa), t-Bu denotes a tertiary butyl group, and Me denotes a methyl group.

Structural Formula (IIb)

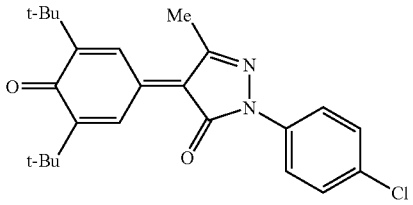

In Structural Formula (IIb), t-Bu denotes a tertiary butyl group, and Me denotes a methyl group.

Structural Formula (IIc)

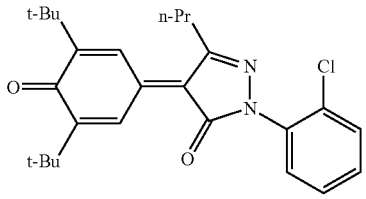

In Structural Formula (IIc), t-Bu denotes a tertiary butyl group, and n-Pr denotes an n-propyl group.

Structural Formula (IId)

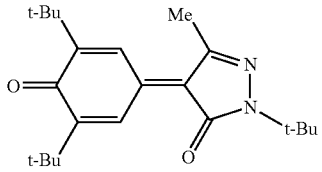

In Structural Formula (IId), t-Bu denotes a tertiary butyl group, and Me denotes a methyl group.

Structural Formula (IIe)

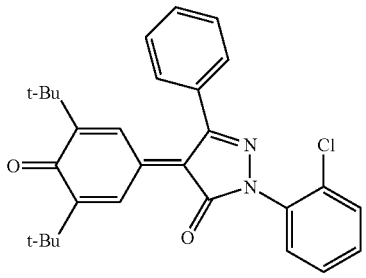

In Structural Formula (IIe), t-Bu denotes a tertiary butyl group.

Structural Formula (IIf)

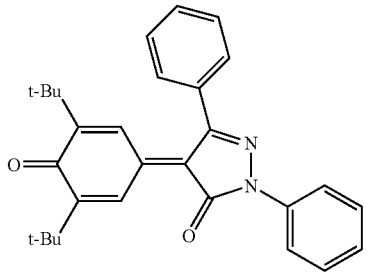

In Structural Formula (IIf), t-Bu denotes a tertiary butyl group.

The amount of the additive represented by General Formula (II) contained in the charge transporting layer is preferably in the range of 0.01 parts by mass to 0.20 parts by mass with respect to 1.0 part by mass of the charge transporting material also contained therein. When the amount of the additive is less than 0.01 parts by mass with respect to 1.0 part by mass of the charge transporting material, there may be such adverse effects as a decrease in light resistance and a great variation in image density. When the amount of the additive is greater than 0.20 parts by mass with respect to 1.0 part by mass of the charge transporting material, there may be a degradation of electrical properties, for example an increase in residual potential.

—Binder Resin—

The binder resin is not particularly limited and may be suitably selected according to the purpose. Examples of the binder resin include polycarbonate resins, styrene resins, acrylic resins, styrene-acrylic resins, ethylene-vinyl acetate resins, polypropylene resins, vinyl chloride resins, chlorinated polyethers, vinyl chloride-vinyl acetate resins, polyester resins, furan resins, nitrile resins, alkyd resins, polyacetal resins, polymethylpentene resins, polyamide resins, polyurethane resins, epoxy resins, polyarylate resins, diarylate resins, polysulfone resins, polyether sulfone resins, polyarylsulfone resins, silicone resins, ketone resins, polyvinyl butyral resins, polyether resins, phenol resins, EVA (ethylene-vinyl acetate) resins, ACS (acrylonitrile-chlorinated polyethylene-styrene) resins, ABS (acrylonitrile-butadiene-styrene) resins and epoxy acrylate resins. These may be used individually or in combination.

It is particularly desirable that the charge transporting layer include two polycarbonate resins and that one of the polycarbonate resins be a compound represented by General Formula (III) below because, if so, electrical properties are not impaired and superior mechanical properties such as abrasion resistance can be obtained:

General Formula (III)

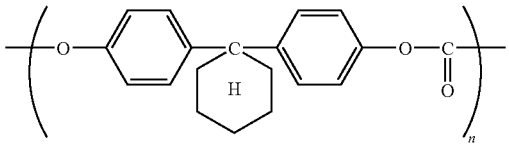

where n denotes the number of times the repeat unit is repeated such that the one of the polycarbonate resins has a viscosity average molecular weight of 20,000 to 50,000.

The charge transporting layer preferably includes an ultraviolet absorber. Examples of the ultraviolet absorber include benzotriazoles such as 2-(5-methyl-2-hydroxyphenyl)benzotriazole, 2-[2-hydroxy-3,5-bis(α,α-dimethylbenzyl)phenyl]-2H-benzotriazole, 2-(3,5-di-tert-butyl-2-hydroxyphenyl)benzotriazole, 2-(3-tert-butyl-5-methyl-2-hydroxyphenyl-5-chlorobenzotriazole, 2-(3,5-di-tert-butyl-2-hydroxyphenyl-5-chlorobenzotriazole, 2-(3,5-di-tert-amyl-2-hydroxyphenyl)benzotriazole and 2-(2'-hydroxy-5'-tert-octylphenyl)benzotriazole; and salicylic acid compounds such as phenyl salicylate, salicylic acid-p-tert-butylphenyl and salicylic acid-p-octylphenyl. These may be used individually or in combination. Among these, benzotriazole-based ultraviolet absorbers are particularly preferable.

The charge transporting layer preferably includes an antioxidant. As this antioxidant, a phenolic antioxidant is suitable.

Examples of the phenolic antioxidant include monophenols such as 2,6-di-tert-butylphenol, 2,6-di-tert-4-methoxyphenol, 2-tert-butyl-4-methoxyphenol, 2,4-dimethyl-6-tert-butylphenol, 2,6-di-tert-butyl-4-methylphenol, butylated hydroxyanisole, stearyl propionate-β-(3,5-di-tert-butyl-4-hydroxyphenyl), α-tocopherol, β-tocopherol and n-octadecyl-3-(3'-5'-di-tert-butyl-4'-hydroxyphenyl)propionate; and polyphenols such as 2,2'-methylenebis(6-tert-butyl-4-methylphenol), 4,4'-butylidene-bis-(3-methyl-6-tert-butylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl) benzene and tetrakis [methylene-3(3,5-di-tert-butyl-4-hydroxyphenyl)propionate]methane. These may be used individually or in combination.

The amount of the ultraviolet absorber or the antioxidant added is preferably in the range of 3 parts by mass to 20 parts by mass with respect to 100 parts by mass of a combination of the binder resin and the charge transporting material.

The method of forming the charge transporting layer is not particularly limited and may be selected from various methods. Generally though, it is preferable to employ a method in which a coating solution prepared by dispersing or dissolving in a solvent a charge transporting material and an additive along with a binder resin is applied onto a charge generating layer and dried, or suchlike method.

The solvent is not particularly limited and may be suitably selected according to the purpose. Examples of the solvent include alcohols such as methanol, ethanol, n-propanol, i-propanol and butanol; saturated aliphatic hydrocarbons such as pentane, hexane, heptane, octane, cyclohexane and cycloheptane; aromatic hydrocarbons such as toluene and xylene; chlorinated hydrocarbons such as dichloromethane, dichloroethane, chloroform and chlorobenzene; ethers such as dimethyl ether, diethyl ether, tetrahydrofuran (THF), methoxy ethanol, dimethoxy ethane, dioxane, dioxolan and anisole; ketones such as acetone, methyl ethyl ketone, methyl isobutyl ketone and cyclohexanone; esters such as ethyl formate, propyl formate, methyl acetate, ethyl acetate, propyl acetate, butyl acetate and methyl propionate; and compounds such as N,N-dimethylformamide and dimethyl sulfoxide. These may be used individually or in combination.

Among these, ketone-based solvents, ester-based solvents, ether-based solvents and halogenated hydrocarbon-based solvents are particularly preferable.

It is desirable, in view of resolution and responsiveness, that the charge transporting layer have a thickness of 40 μm or less. The lower limit value of the thickness varies depending upon the system (particularly charge potential, etc.) employed, but is preferably 15 μm or greater.

<Charge Generating Layer>

The charge generating layer includes at least a charge generating material, preferably includes a binder resin and, if necessary, includes other component(s).

—Charge Generating Material—

The charge generating material is not particularly limited and may be selected from known charge generating materials. Examples thereof include azo pigments such as monoazo pigments, disazo pigments, asymmetrical disazo pigments, trisazo pigments, azo pigments containing carbazole skeletons (refer to JP-A No. 53-95033), azo pigments containing distyrylbenzene skeletons (refer to JP-A No. 53-133445), azo pigments containing triphenylamine skeletons (refer to JP-A No. 53-132347), azo pigments containing diphenylamine skeletons, azo pigments containing dibenzothiophene skeletons (refer to JP-A No. 54-21728), azo pigments containing fluorenone skeletons (refer to JP-A No. 54-22834), azo pigments containing oxadiazole skeletons (refer to JP-A No. 54-12742), azo pigments containing bisstilbene skeletons (refer to JP-A No. 54-17733), azo pigments containing distyryl oxadiazole skeletons (refer to JP-A No. 54-2129) and azo pigments containing distyryl carbazole skeletons (refer to JP-A No. 54-14967); azulenium salt pigments, methine squarate pigments, perylene-based pigments, anthraquinone-based pigments, polycyclic quinone-based pigments, quinonimine-based pigments, diphenyl methane-based pigments, triphenyl methane-based pigments, benzoquinone-based pigments, naphthoquinone-based pigments, cyanine-based pigments, azomethine-based pigments, indigoid-based pigments, bisbenzimidazole-based pigments, and phthalocyanine-based pigments such as metal phthalocyanines and metal-free phthalocyanines.

Figure 4:
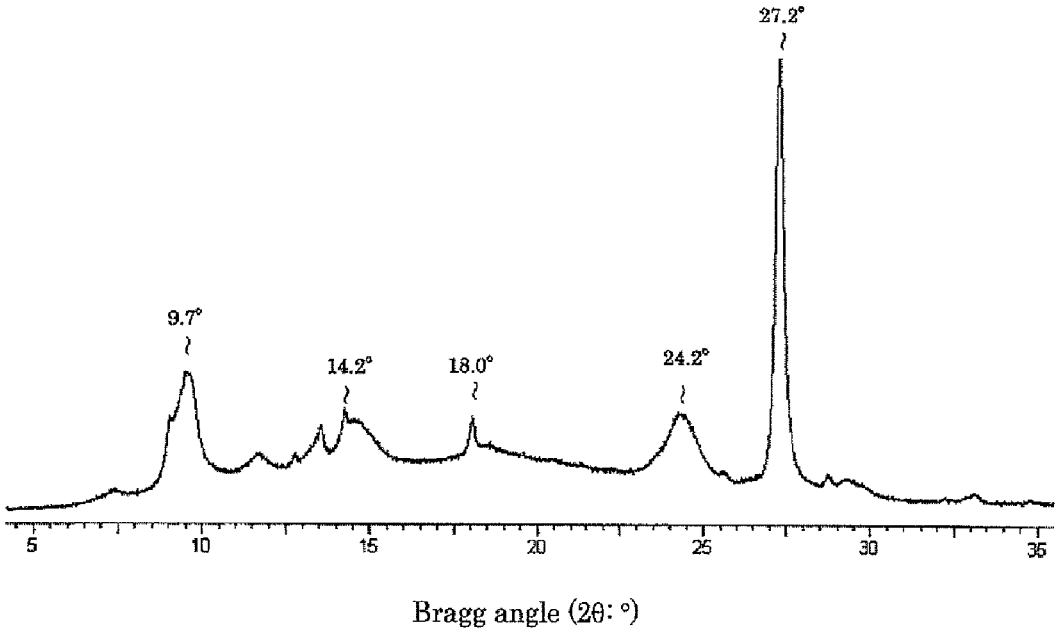
FIG. 4 is a diagram showing an X-ray diffraction peak of Y-type oxytitanium phthalocyanine, where the vertical axis represents the intensity (counts/s) and the horizontal axis represents the Bragg angle (2θ: °).
Figure 5:
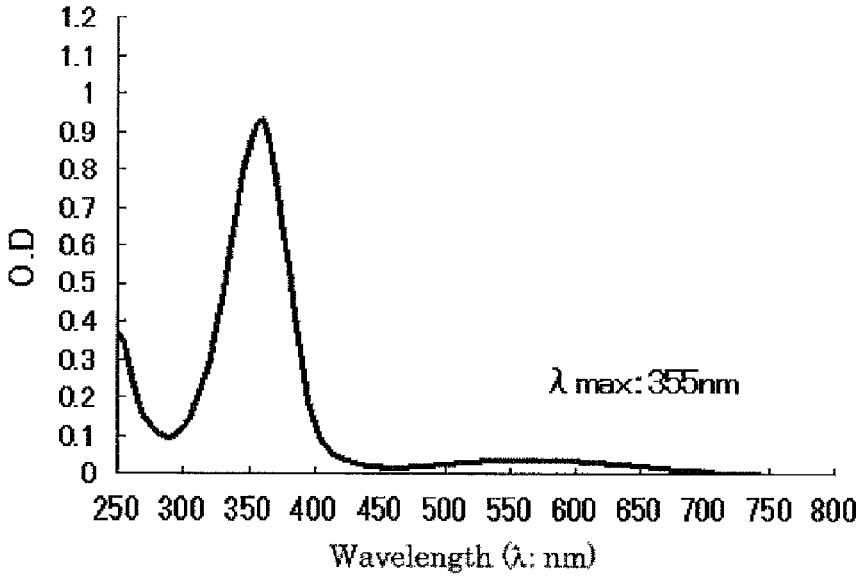
FIG. 5 is a graph showing an absorbance waveform of the additive represented by Structural Formula (IIa).
Figure 6:
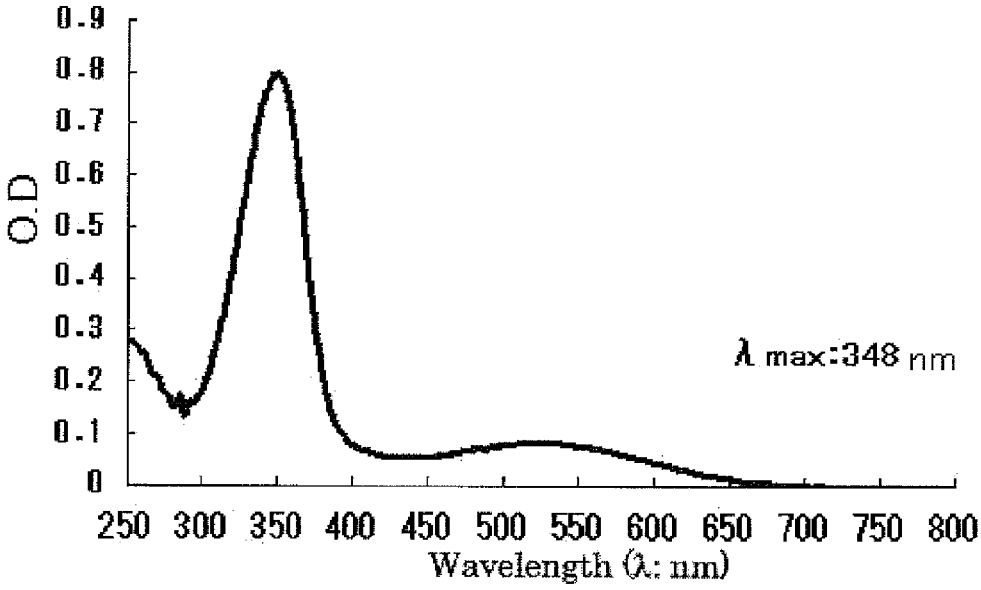
FIG. 6 is a graph showing an absorbance waveform of the additive represented by Structural Formula (IIe).
Figure 7:
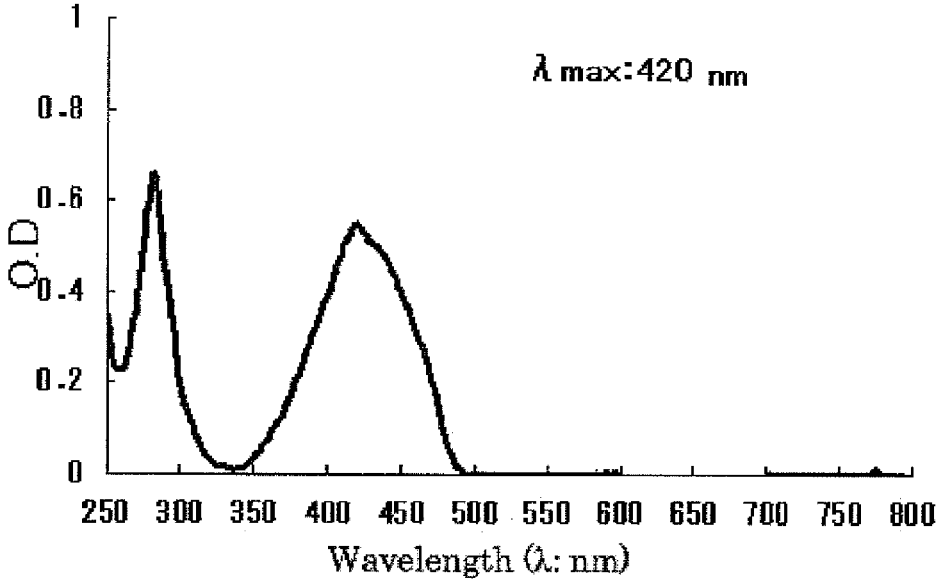
FIG. 7 is a graph showing an absorbance waveform of C.I. Solvent Yellow 33.
Figure 8:
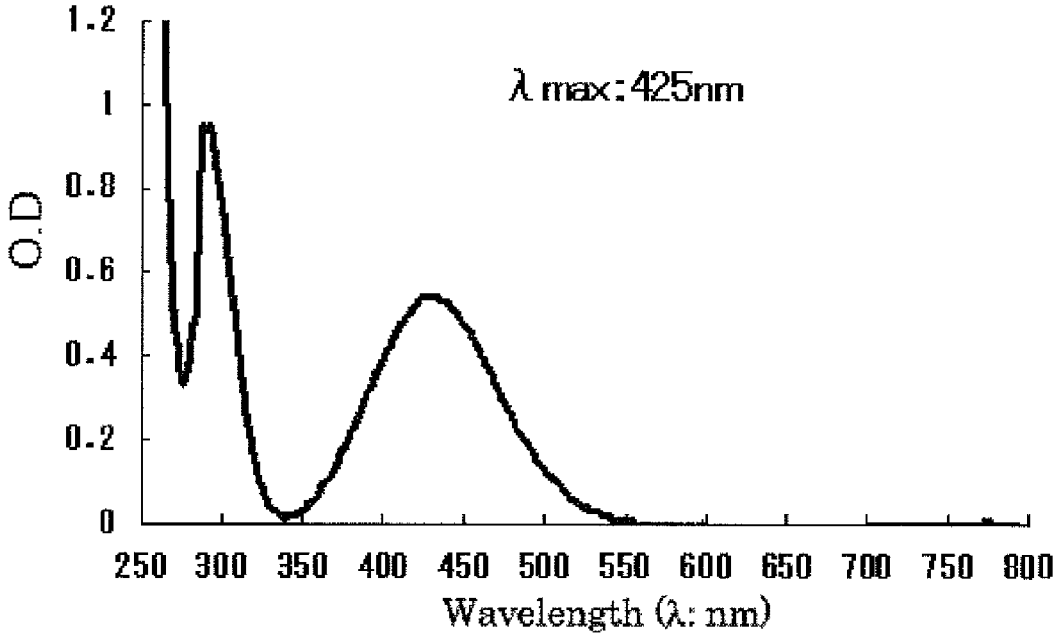
FIG. 8 is a graph showing an absorbance waveform of the additive represented by Structural Formula (K).

Among these, oxytitanium phthalocyanine is preferable because of having high sensitivity characteristics, and Y-type oxytitanium phthalocyanine related to the diagram of an X-ray diffraction peak shown in FIG. 4 is particularly preferable. Such compounds can be favorably combined with the charge transporting material used in the present invention.

—Binder Resin—

The binder resin used in the charge generating layer is not particularly limited and may be suitably selected according to the purpose. Examples of the binder resin include polyamides, polyurethanes, epoxy resins, polyketones, polycarbonates, silicone resins, acrylic resins, polyvinyl butyral, polyvinyl formal, polyvinyl ketone, polystyrene, poly-N-vinyl carbazole, polyacrylamide, polyvinyl benzal, polyesters, phenoxy resins, vinyl chloride-vinyl acetate copolymers, polyvinyl acetate, polyphenylene oxide, polyvinyl pyridine, cellulose-based resins, casein, polyvinyl alcohol and polyvinylpyrrolidone. These may be used individually or in combination.

A coating solution for the charge generating layer can be obtained by dispersing in a solvent the charge generating material, if necessary along with the binder resin, using a known dispersing method with a ball mill, an attritor, a sand mill, a supersonic wave or the like. The binder resin may be added before or after the charge generating material is dispersed. The coating solution for the charge generating layer is mainly composed of the charge generating material, the solvent and the binder resin and may also include additive(s) such as a sensitizer, a dispersant, a surfactant, silicone oil, etc. Depending upon the case, the after-mentioned charge transporting material may be added to the charge generating layer. The amount of the binder resin added is preferably 500 parts by mass or less, more preferably in the range of 10 parts by mass to 300 parts by mass, with respect to 100 parts by mass of the charge generating material.

Examples of the solvent include organic solvents for general use, such as isopropanol, acetone, methyl ethyl ketone, dioxolan, cyclohexanone, tetrahydrofuran, dioxane, ethyl cellosolve, ethyl acetate, methyl acetate, dichloro methane, dichloro ethane, monochloro benzene, cyclohexane, toluene, xylene and ligroin, with preference being given to ketone-based solvents, ester-based solvents and ether-based solvents. These may be used individually or in combination.

The charge generating layer is formed by applying the coating solution onto the substrate or onto an underlayer, etc. and drying the coating solution. For the application of the coating solution, a known method can be used such as immersion coating, spray coating, bead coating, nozzle coating, spinner coating or ring coating. As for the drying after the application, the coating solution is heated and dried using an oven or the like. The temperature at which the coating solution is dried is preferably 50° C. to 160° C., more preferably 80° C. to 140° C.

The charge generating layer preferably has a thickness of 0.01 μm to 5 μm, more preferably 0.1 μm to 2 μm.

<Substrate>

The substrate is not particularly limited as long as it is so conductive as to have a volume resistivity of $10^{10}$ Ω·cm or less, and the substrate may be suitably selected according to the purpose. Examples thereof include a construction formed by coating a film-like or cylindrical piece of plastic or paper with a metal such as aluminum, nickel, chrome, Nichrome, copper, gold, silver or platinum or with a metal oxide such as tin oxide or indium oxide by means of vapor deposition or sputtering; a plate of aluminum, aluminum alloy, nickel, stainless steel, etc.; and a tube produced by forming the plate into a mother tube by means of extrusion, drawing, etc. and then subjecting the mother tube to surface treatment such as cutting, superfinishing, polishing, etc. Also, any one of the endless nickel belt and the endless stainless steel belt disclosed in JP-A No. 52-36016 may be used as the substrate. Further, nickel foil having a thickness of 50 μm to 150 μm, or a polyethylene terephthalate film having a thickness of 50 μm to 150 μm with its surface subjected to treatment for conductivity, such as aluminum vapor deposition, may be used.

In the case where the substrate is cylindrical in shape, the substrate preferably has a diameter of 60 mm or less, more preferably 30 mm or less.

In particular, a conductive substrate made of an aluminum alloy of JIS 3000 series, JIS 5000 series, JIS 6000 series or the like and formed according to a conventional method such as EI (Extrusion Ironing) method, ED (Extrusion Drawing) method, DI (Drawing Ironing) method or II (Impact Ironing) method is preferable. The conductive substrate may be subjected to surface cutting using a diamond bite or the like, and/or a surface treatment such as polishing or anodic oxidation; alternatively, the conductive substrate may be an uncut tube not subjected to such cutting or treatment.

Besides, a conductive powder dispersed in a certain binder resin so as to form a conductive layer may be applied onto the substrate.

Examples of the conductive powder include carbon black and acetylene black; powders of metals such as aluminum, nickel, iron, Nichrome, copper, zinc and silver; and powders of metal oxides such as conductive tin oxide and ITO. Examples of the binder resin used together with the conductive powder include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinyl carbazole, acrylic resins, silicone resins, epoxy resins, melamine resins, urethane resins, phenol resins and alkyd resins.

The conductive layer can, for example, be provided by dispersing any of these conductive powders and any of these binder resins into a certain solvent such as tetrahydrofuran, dichloromethane, methyl ethyl ketone or toluene and then applying the mixture.

Further, a certain cylindrical substrate with a conductive layer formed of a heat-shrinkable tube made of a material such as polyvinyl chloride, polypropylene, polyester, polystyrene, polyvinylidene chloride, polyethylene, chlorinated rubber or Teflon (registered trademark), that contains the conductive powder can be favorably used as the conductive substrate.

—Surface Protecting Layer—

On the photosensitive layer, an organic thin film made of a polyvinyl formal resin, a polycarbonate resin, a fluorine resin, a polyurethane resin, a silicone resin or the like, or a thin film having a siloxane structure formed of a hydrolysate of a silane coupling agent may be deposited as a surface protecting layer. The provision of the surface protecting layer is preferable in that the durability of the photoconductor can improve. The surface protecting layer may be provided to improve properties other than the durability.

—Underlayer—

An underlayer may, if necessary, be provided between the substrate and the photosensitive layer. The underlayer is provided for purposes such as improvement in adhesion, prevention of moire, improvement in the applicability of upper layer(s), and reduction in residual potential.

The underlayer contains at least a resin and a fine powder and, if necessary, contains other component(s).

Examples of the resin include water-soluble resins such as polyvinyl alcohol resins, casein and sodium polyacrylate; alcohol-soluble resins such as copolymer nylons and methoxymethylated nylons; and curable resins which form three-dimensional network structures, such as polyurethane resins, melamine resins, alkyd-melamine resins and epoxy resins.

Examples of the fine powder include powders of metal oxides such as titanium oxide, silica, alumina, zirconium oxide, tin oxide and indium oxide, metal sulfides, and metal nitrides.

The underlayer may also contain a silane coupling agent, a titanium coupling agent, a chromium coupling agent or the like. Further, the underlayer may, for example, be provided with $Al_2O_3$ by anodic oxidation or provided with an organic material such as polyparaxylylene (parylene) or an inorganic material such as $SiO_2$, $SnO_2$, $TiO_2$, ITO or $CeO_2$ by a vacuum thin film producing method.

The thickness of the underlayer is not particularly limited and may be suitably selected according to the purpose but is preferably 0.1 μm to 10 μm, more preferably 1 μm to 5 μm.

In the electrophotographic photoconductor of the present invention, an antioxidant, a plasticizer, a lubricant, an ultraviolet absorber, a low-molecular charge transporting material, and/or a leveling agent may if necessary be added to each of the layers including the charge generating layer, the charge transporting layer, the underlayer and the surface protecting layer.

(Image Forming Apparatus)

An image forming apparatus of the present invention includes at least: an electrophotographic photoconductor, a charging unit, an exposing unit, a developing unit, a transfer unit and a fixing unit. Further, the image forming apparatus, if necessary, includes suitably selected other unit(s) such as a cleaning unit, a charge eliminating unit, a recycling unit and a control unit.

As the electrophotographic photoconductor, the above-mentioned electrophotographic photoconductor of the present invention is employed.

An image forming method used in the present invention includes at least a charging step, an exposing step, a developing step, a transfer step and a fixing step. Further, the image forming method, if necessary, includes suitably selected other step(s) such as a cleaning step, a charge eliminating step, a recycling step and a control step.

The image forming method used in the present invention can be suitably put into practice by the image forming apparatus of the present invention; specifically, the charging step can be suitably put into practice by the charging unit, the exposing step can be suitably put into practice by the exposing unit, the developing step can be suitably put into practice by the developing unit, the transfer step can be suitably put into practice by the transfer unit, the fixing step can be suitably put into practice by the fixing unit, and the other step(s) can be suitably put into practice by the other unit(s).

—Charging Step and Charging Unit—

The charging step is a step of charging the surface of the electrophotographic photoconductor and is put into practice by the charging unit.

The charging unit is not particularly limited as long as it can apply a voltage to the surface of the electrophotographic photoconductor so as to charge the surface uniformly, and the charging unit may be suitably selected according to the purpose but is preferably a contact charging unit in the form of a brush, a roller or the like, or a non-contact charging unit which charges the surface of the electrophotographic photoconductor without touching the surface.

Examples of the non-contact charging unit include a solid discharge element, a needle electrode device and a non-contact charger utilizing corona discharge; and a conductive/semiconductive charging roller placed slightly apart from the electrophotographic photoconductor.

—Exposing Step and Exposing Unit—

The exposing step can, for example, be put into practice by exposing the surface of the electrophotographic photoconductor imagewise, using the exposing unit, and a latent electrostatic image is thus formed on the surface.

Optical systems for the exposure are broadly classified into an analogue optical system and a digital optical system. The analogue optical system directly projects the information of a document onto an electrophotographic photoconductor, while the digital optical system converts image information provided in the form of an electrical signal to an optical signal and exposes an electrophotographic photoconductor according to the optical signal to form an image.

The exposing unit is not particularly limited as long as it can expose the surface of the electrophotographic photoconductor charged by the charging unit, in a manner that corresponds to an intended image to be formed, and the exposing unit may be suitably selected according to the purpose. Examples thereof include exposing devices based upon a copy optical system, a rod lens array, a laser optical system, a liquid crystal shutter optical system, an LED optical system, etc.

In the present invention, a back surface lighting method may be employed in which imagewise exposure is performed from the back surface side of the electrophotographic photoconductor.

—Developing Step and Developing Unit—

The developing step is a step of developing the latent electrostatic image using a toner or a developer so as to form a visible image.

The visible image can be formed, for example by developing the latent electrostatic image using the toner or the developer, which can be suitably carried out by the developing unit.

The developing unit is not particularly limited as long as it can develop the latent electrostatic image using the toner or the developer, and the developing unit may be suitably selected from known developing units. Examples thereof include a developing unit incorporating at least a developing device which houses the toner or the developer and is capable of supplying the toner or the developer to the latent electrostatic image in a contact or non-contact manner.

The developing device may be of dry developing type or of wet developing type and may be a developing device for a single color or a developing device for multiple colors. Examples thereof include a developing device incorporating an agitator for agitating the toner or the developer by friction and thus charging it, and also incorporating a rotatable magnet roller.

In the developing device, for example, the toner and a carrier are mixed and agitated, and the toner is charged by the friction and is held in an upright position on the surface of the rotating magnet roller, thereby forming a magnetic brush. Since the magnet roller is placed in the vicinity of the electrophotographic photoconductor (photoconductor), part of the toner constituting the magnetic brush formed on the surface of the magnet roller moves to the surface of the electrophotographic photoconductor by electrical suction. As a result of it, the latent electrostatic image is developed with the toner, and a visible image composed of the toner is formed on the surface of the electrophotographic photoconductor.

The developer housed in the developing device is a developer containing the toner, and the developer may be a one-component developer or two-component developer.

—Transfer Step and Transfer Unit—

The transfer step is a step of transferring the visible image onto a recording medium. A preferred aspect of the transfer step is such that an intermediate transfer member is used, a visible image is primarily transferred onto the intermediate transfer member and then the visible image is secondarily transferred onto the recording medium. A more preferred aspect of the transfer step is such that toners of two or more colors, preferably full-color toners, are used, and there are provided a primary transfer step of transferring visible images onto an intermediate transfer member so as to form a compound transfer image thereon, and a secondary transfer step of transferring the compound transfer image onto a recording medium.

The transfer step can, for example, be put into practice by charging the electrophotographic photoconductor with the visible image, using a transfer charger, which can be suitably carried out by the transfer unit. A preferred aspect of the transfer unit is such that there are provided a primary transfer unit configured to transfer visible images onto an intermediate transfer member so as to form a compound transfer image thereon, and a secondary transfer unit configured to transfer the compound transfer image onto a recording medium.

The intermediate transfer member is not particularly limited and may be suitably selected from known transfer members according to the purpose. Suitable examples thereof include a transfer belt.

The transfer unit (primary transfer unit and secondary transfer unit) preferably includes at least a transfer device for charging and thus separating the visible image formed on the electrophotographic photoconductor toward the recording medium side. Regarding the transfer unit(s), one transfer unit, or two or more transfer units may be provided. Examples of the transfer device include a corona transfer device utilizing corona discharge, a transfer belt, a transfer roller, a pressure transfer roller and an adhesion transfer device.

The recording medium is typified by plain paper but is not particularly limited as long as an unfixed image that has been developed can be transferred onto the recording medium, and the recording medium may be suitably selected according to the purpose. Examples thereof include a PET base for an OHP.

—Fixing Step and Fixing Unit—

The fixing step is a step of fixing the transferred visible image to the recording medium, using a fixing device. Toners of each color may be individually fixed upon transfer thereof to the recording medium; alternatively, the toners of each color may be fixed at one time in a superimposed state.

The fixing unit is not particularly limited and may be suitably selected according to the purpose but preferably includes a fixing member and a heat source for heating the fixing member.

The fixing member is, for example, a combination of a roller and an endless belt, or a combination of a roller and a roller. Preference is given to a combination of a roller and an endless belt with small heat capacity because the time for a warm-up can be shortened, energy saving can be realized, and the width of an image able to be fixed can be increased.

The charge eliminating step is a step of eliminating charge by applying a charge eliminating bias to the electrophotographic photoconductor, which can be suitably carried out by the charge eliminating unit.

The charge eliminating unit is not particularly limited as long as it can apply a charge eliminating bias to the electrophotographic photoconductor, and it may be suitably selected from known charge eliminating devices. Suitable examples thereof include a charge eliminating lamp.

The cleaning step is a step of removing the toner remaining on the electrophotographic photoconductor, which can be suitably carried out by the cleaning unit. Here, note that it is possible to employ a method which does not use the cleaning unit and includes making the charge of residual toner uniform by means of a rubbing member and collecting the residual toner with a developing roller.

The cleaning unit is not particularly limited as long as it can remove the toner remaining on the electrophotographic photoconductor, and it may be suitably selected from known cleaners. Suitable examples thereof include a magnetic brush cleaner, an electrostatic brush cleaner, a magnetic roller cleaner, a blade cleaner, a brush cleaner and a web cleaner.

The recycling step is a step of returning the toner removed by the cleaning step to the developing unit, which can be suitably carried out by the recycling unit. The recycling unit is not particularly limited and may, for example, be a known conveyance unit.

The control step is a step of controlling the above-mentioned steps, which can be suitably carried out by the control unit.

The control unit is not particularly limited as long as it can control operations of the above-mentioned units, and the control unit may be suitably selected according to the purpose. Examples thereof include apparatuses such as a sequencer and a computer.

Figure 2:
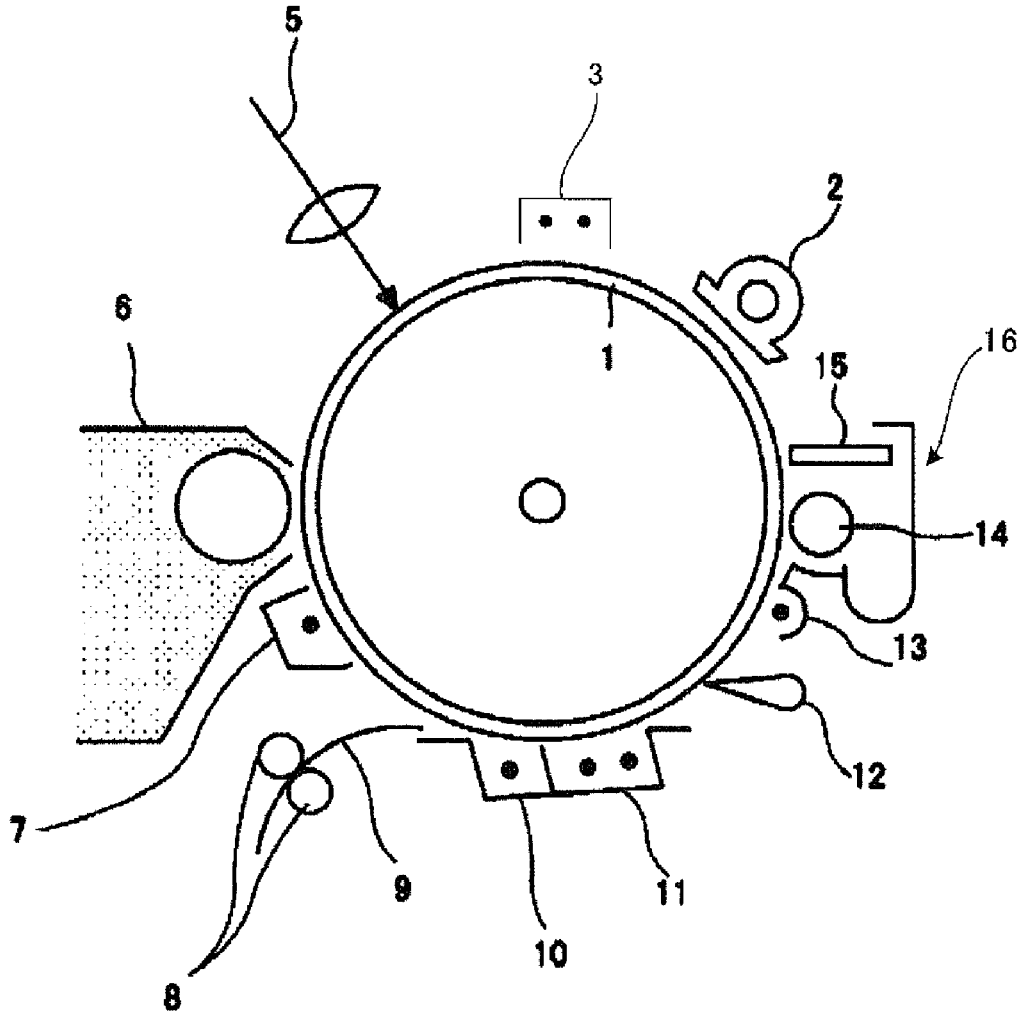
FIG. 2 is a schematic drawing showing an example of an image forming apparatus of the present invention.

FIG. 2 is a schematic drawing showing an example of the image forming apparatus of the present invention. In FIG. 2, an electrophotographic photoconductor 1 is the above-mentioned electrophotographic photoconductor of the present invention. Although shaped like a drum in FIG. 2, the photoconductor 1 may be in the form of a sheet or endless belt.

Non-contact charging units utilizing corona discharge, such as corotron chargers, scorotron chargers and solid-state chargers are used for a charging charger 3, a pre-transfer charger 7, a transfer charger 10, a separation charger 11 and a pre-cleaning charger 13.

For the transfer unit, the above-mentioned charger can be generally used; as shown in FIG. 2, use of the transfer charger 10 and the separation charger 11 in combination is effective.

Light sources of an exposing member 5, a charge eliminating lamp 2, etc. may be selected from a large variety of light-emitting objects including fluorescent lamps, tungsten lamps, halogen lamps, mercury-vapor lamps, sodium-vapor lamps, light emitting diodes (LEDs), laser diodes (LDs) and electroluminescence (EL). To apply light in a desired wavelength range exclusively, filters such as a sharp cut filter, a band pass filter, a near-infrared cut filter, a dichroic filter, an interference filter and a color-temperature conversion filter may be used.

Also regarding light sources and the like, the photoconductor is irradiated with light, as a transfer step, a charge eliminating step, a cleaning step, a pre-exposing step or the like, which involves light irradiation, is provided besides the steps shown in FIG. 2.

Next, a toner image developed on the photoconductor 1 by a developing unit 6 is transferred onto a recording medium 9. Here, it is not that all the toner used therefor is transferred but that there is some toner remaining on the photoconductor 1. Such residual toner is removed from the photoconductor by a cleaning unit 16 composed of a fur brush 14 and a blade 15. The cleaning may be performed only with a cleaning brush, as which a known brush such as a fur brush or magfur brush is used.

When the electrophotographic photoconductor is charged positively (negatively) and then exposed imagewise, a positive (negative) latent electrostatic image is formed on the photoconductor surface. In the case where the positive (negative) latent electrostatic image is developed with a toner (electroscopic fine particles) having a negative (positive) polarity, a positive image is obtained. In the case where the positive (negative) latent electrostatic image is developed with a toner having a positive (negative) polarity, a negative image is obtained. A known unit is used as the developing unit.

The wavelength of the charge eliminating lamp 2 as a charge eliminating unit is not particularly limited as long as it is in the wavelength range where the photoconductor has photosensitivity. The wavelength of the charge eliminating lamp 2 is preferably on the long-wavelength side in a practical photosensitive wavelength range for the photoconductor.

(Process Cartridge)

A process cartridge of the present invention includes an electrophotographic photoconductor and at least one unit selected from a charging unit, an exposing unit, a developing unit, a transfer unit, a cleaning unit and a charge eliminating unit, and the process cartridge is detachably mountable to a main body of an image forming apparatus.

As the electrophotographic photoconductor, the above-mentioned electrophotographic photoconductor of the present invention is employed.

Figure 3:
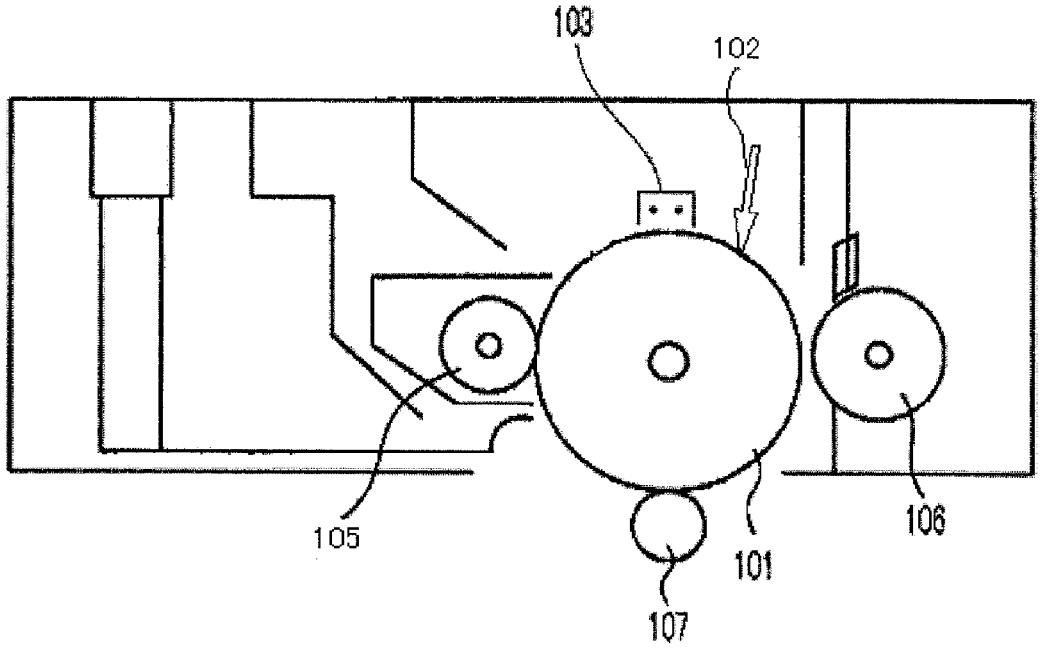
FIG. 3 is a schematic drawing showing an example of a process cartridge of the present invention.

FIG. 3 is a schematic drawing showing the structure of an image forming apparatus provided with the process cartridge of the present invention.

In FIG. 3, 101 denotes a photoconductor, 103 denotes a charging unit, 102 denotes exposure performed by an exposing unit, 106 denotes a developing unit, 107 denotes a transfer unit, and 105 denotes a cleaning unit.

In the present invention, among constituent units including the photoconductor 101, the charging unit 103, the developing unit 106 and the cleaning unit 105, at least the photoconductor 101 and the developing unit 106 constitute a single unit as a process cartridge, and this process cartridge can be made detachably mountable to the main body of an image forming apparatus such as a copier or a printer.

EXAMPLES

The following explains Examples of the present invention. It should, however, be noted that the present invention is not confined to these Examples in any way.

Example 1

Production of Electrophotographic Photoconductor

An alkyd resin (BECKOLITE M-6401-50, manufactured by Dainippon Ink And Chemicals, Incorporated) and an amino resin (SUPER BECKAMINE G-821-60, manufactured by Dainippon Ink And Chemicals, Incorporated) were mixed at a ratio (mass ratio) of 65:35, then this mixed resin and titanium oxide (CR-EL, manufactured by ISHIHARA SANGYO KAISHA, LTD.) were dissolved in methyl ethyl ketone, with the ratio (mass ratio) of the mixed resin to the titanium oxide being 1:3, so as to prepare a coating solution. This coating solution was applied onto a cylindrical drum (hereinafter also referred to as "substrate") (24 mm in diameter) made of uncut aluminum, and then dried so as to form an underlayer (1.5 μm in thickness).

Next, into a solution prepared by dissolving 10 g of a polyvinyl butyral resin (BM-1, manufactured by SEKISUI CHEMICAL CO., LTD.) in 500 ml of 1,3-dioxolan, 10 g of oxytitanium phthalocyanine powder having such a crystalline system as shown in FIG. 4 was added along with glass beads and then dispersed using a sand mill dispersing machine for 20 hours so as to obtain a dispersion solution. The dispersion solution was filtered so as to remove the glass beads therefrom, and a coating solution for a charge generating layer was thus prepared. This coating solution was applied onto the underlayer by immersion coating and dried so as to form a charge generating layer (0.2 μm in thickness).

Next, a binder resin prepared by mixing a polycarbonate resin represented by General Formula (III) below with a polycarbonate copolymer resin represented by a combination of Structural Formulae (A), (B) and (C) below at a mass ratio of 0.2:0.8, the compound represented by Structural Formula (Ia) below as a charge transporting material, the compound represented by Structural Formula (IIa) as an additive, and the compound represented by Structural Formula (D) as an ultraviolet absorber were mixed at a mass ratio of 1.0:1.0:0.02:0.1 and then dissolved in tetrahydrofuran so as to prepare a coating solution for a charge transporting layer (hereinafter, also referred to as "charge transporting layer coating solution").

Subsequently, the substrate over which the underlayer and the charge generating layer had been formed was subjected to immersion coating with the coating solution for a charge transporting layer and then dried at 130° C. for 60 minutes so as to form a charge transporting layer (25.0 μm in thickness). By the above-mentioned procedure, an electrophotographic photoconductor of Example 1 was produced.

General Formula (III)

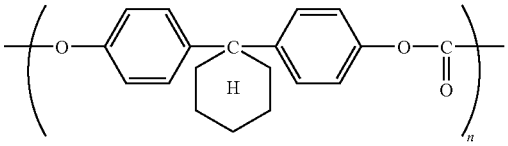

In General Formula (III), n denotes the number of times the repeat unit is repeated such that the polycarbonate resin has a viscosity average molecular weight of 20,000 to 50,000.

Strurctual Formula (A)

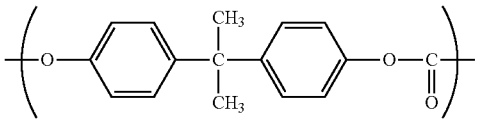

Structural Formula (B)

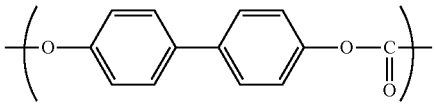

Structural Formula (C)

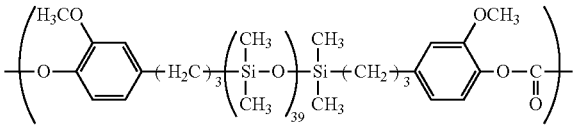

Structural Formula (D)

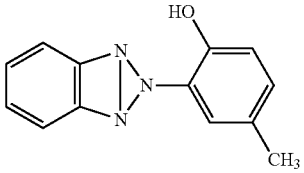

Structural Formula (Ia)

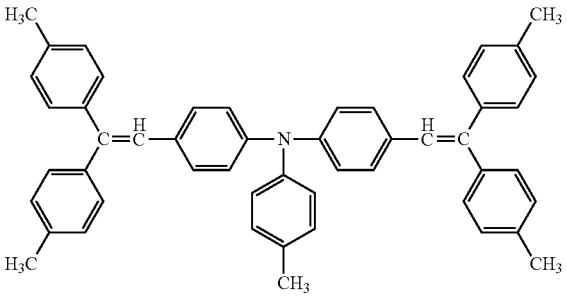

Structural Formula (IIa)

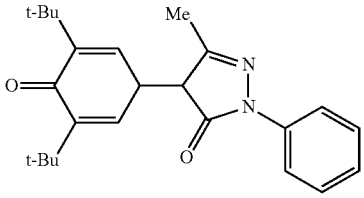

In Structural Formula (IIa), t-Bu denotes a tertiary butyl group, and Me denotes a methyl group.

Example 2

Production of Electrophotographic Photoconductor

An electrophotographic photoconductor was produced in the same manner as in Example 1 except that, in the charge transporting layer coating solution, the charge transporting material represented by Structural Formula (Ib) below was used instead of the charge transporting material represented by Structural Formula (Ia) above.

Structural Formula (Ib)

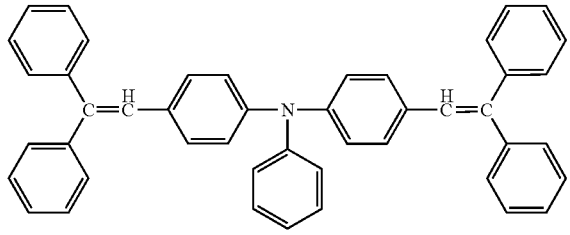

Example 3

Production of Electrophotographic Photoconductor

An electrophotographic photoconductor was produced in the same manner as in Example 1 except that, in the charge transporting layer coating solution, the charge transporting material represented by Structural Formula (Ic) below was used instead of the charge transporting material represented by Structural Formula (Ia) above.

Structural Formula (Ic)

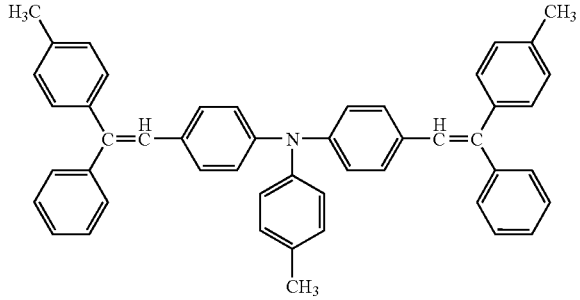

Example 4

Production of Electrophotographic Photoconductor

An electrophotographic photoconductor was produced in the same manner as in Example 1 except that, in the charge transporting layer coating solution, the charge transporting material represented by Structural Formula (Id) below was used instead of the charge transporting material represented by Structural Formula (Ia) above.

Structural Formula (Id)

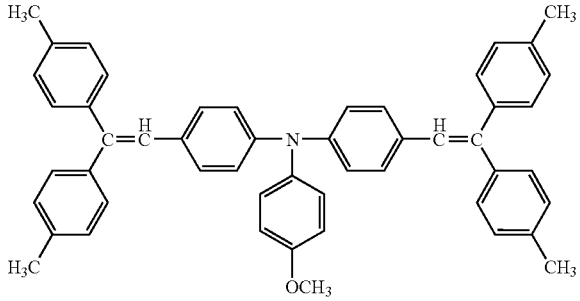

Example 5

Production of Electrophotographic Photoconductor

An electrophotographic photoconductor was produced in the same manner as in Example 1 except that, in the charge transporting layer coating solution, the charge transporting material represented by Structural Formula (Ie) below was used instead of the charge transporting material represented by Structural Formula (Ia) above.

Structural Formula (Ie)

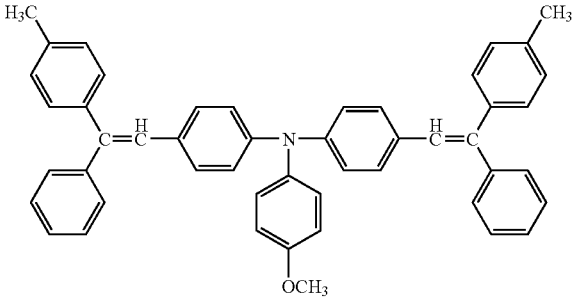

Example 6

Production of Electrophotographic Photoconductor

An electrophotographic photoconductor was produced in the same manner as in Example 1 except that, in the charge transporting layer coating solution, the mass ratio of the binder resin to the charge transporting material represented by Structural Formula (Ia) above to the additive represented by Structural Formula (IIa) above to the ultraviolet absorber represented by Structural Formula (D) above was 1:1:0.01:0.1.

Example 7

Production of Electrophotographic Photoconductor

An electrophotographic photoconductor was produced in the same manner as in Example 1 except that, in the charge transporting layer coating solution, the mass ratio of the binder resin to the charge transporting material represented by Structural Formula (Ia) above to the additive represented by Structural Formula (IIa) above to the ultraviolet absorber represented by Structural Formula (D) above was 1:1:0.2:0.1.

Example 8

Production of Electrophotographic Photoconductor

An electrophotographic photoconductor was produced in the same manner as in Example 1 except that, in the charge transporting layer coating solution, the additive represented by Structural Formula (IIb) below was used instead of the additive represented by Structural Formula (IIa) above.

Structural Formula (IIb)

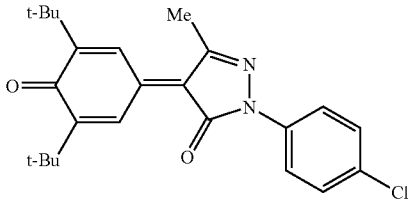

In Structural Formula (IIb), t-Bu denotes a tertiary butyl group, and Me denotes a methyl group.

Example 9

Production of Electrophotographic Photoconductor

An electrophotographic photoconductor was produced in the same manner as in Example 1 except that, in the charge transporting layer coating solution, the additive represented by Structural Formula (IIc) below was used instead of the additive represented by Structural Formula (IIa) above.

Structural Formula (IIc)

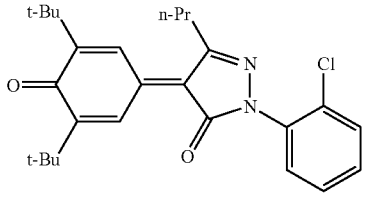

In Structural Formula (IIc), t-Bu denotes a tertiary butyl group, and n-Pr denotes an n-propyl group.

Example 10

Production of Electrophotographic Photoconductor

An electrophotographic photoconductor was produced in the same manner as in Example 1 except that, in the charge transporting layer coating solution, the additive represented by Structural Formula (IId) below was used instead of the additive represented by Structural Formula (IIa) above.

Structural Formula (IId)

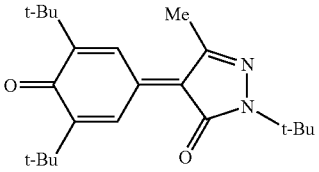

In Structural Formula (IId), t-Bu denotes a tertiary butyl group, and Me denotes a methyl group.

Example 11

Production of Electrophotographic Photoconductor

An electrophotographic photoconductor was produced in the same manner as in Example 1 except that, in the charge transporting layer coating solution, the additive represented by Structural Formula (IIe) below was used instead of the additive represented by Structural Formula (IIa) above.

Structural Formula (IIe)

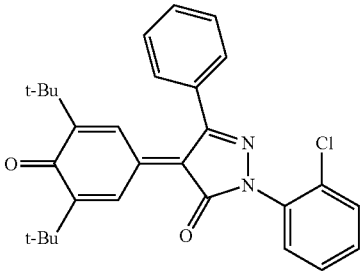

In Structural Formula (IIe), t-Bu denotes a tertiary butyl group.

Example 12

Production of Electrophotographic Photoconductor

An electrophotographic photoconductor was produced in the same manner as in Example 1 except that, in the charge transporting layer coating solution, the additive represented by Structural Formula (IIf) below was used instead of the additive represented by Structural Formula (IIa) above.

Structural Formula (IIf)

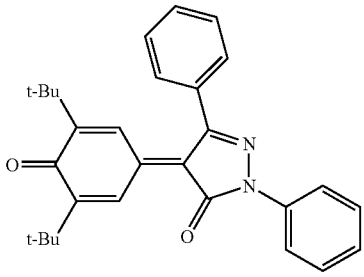

In Structural Formula (IIf), t-Bu denotes a tertiary butyl group.

Example 13

Production of Electrophotographic Photoconductor

An electrophotographic photoconductor was produced in the same manner as in Example 1 except that, in the charge transporting layer coating solution, the antioxidant represented by Structural Formula (F) below was used and the mass ratio of the binder resin to the charge transporting material represented by Structural Formula (Ia) above to the additive represented by Structural Formula (IIa) above to the ultraviolet absorber represented by Structural Formula (D) above to the antioxidant represented by Structural Formula (F) below was 1:1:0.02:0.1:0.1.

Structural Formula (F)

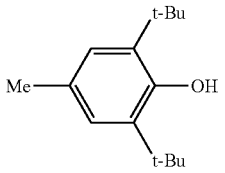

In Structural Formula (F), t-Bu denotes a tertiary butyl group, and Me denotes a methyl group.

Comparative Example 1

Production of Electrophotographic Photoconductor

An electrophotographic photoconductor was produced in the same manner as in Example 1 except that, in the charge transporting layer coating solution, the charge transporting material represented by Structural Formula (G) below was used instead of the charge transporting material represented by Structural Formula (Ia) above.

Structural Formula (G)

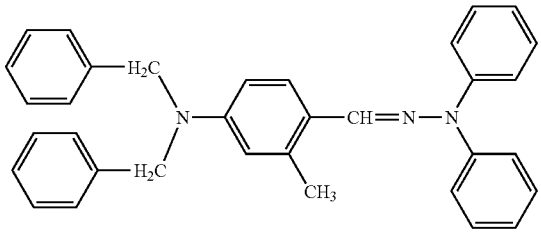

Comparative Example 2

Production of Electrophotographic Photoconductor

An electrophotographic photoconductor was produced in the same manner as in Example 1 except that, in the charge transporting layer coating solution, the charge transporting material represented by Structural Formula (H) below was used instead of the charge transporting material represented by Structural Formula (Ia) above.

Structural Formula (H)

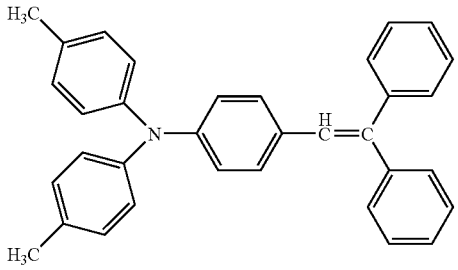

Comparative Example 3

An electrophotographic photoconductor was produced in the same manner as in Example 1 except that, in the charge transporting layer coating solution, the additive represented by Structural Formula (IIa) above was not used.

Comparative Example 4

Production of Electrophotographic Photoconductor

An electrophotographic photoconductor was produced in the same manner as in Example 1 except that, in the charge transporting layer coating solution, the antioxidant represented by Structural Formula (F) above was used instead of the additive represented by Structural Formula (IIa) above.

Comparative Example 5

Production of Electrophotographic Photoconductor

An electrophotographic photoconductor was produced in the same manner as in Example 1 except that, in the charge transporting layer coating solution, the additive C.I. Solvent Yellow 33 was used instead of the additive represented by Structural Formula (IIa) above.

Comparative Example 6

Production of Electrophotographic Photoconductor

An electrophotographic photoconductor was produced in the same manner as in Example 1 except that, in the charge transporting layer coating solution, the additive C.I. Disperse Orange 3 was used instead of the additive represented by Structural Formula (IIa) above.

Comparative Example 7

Production of Electrophotographic Photoconductor

An electrophotographic photoconductor was produced in the same manner as in Example 1 except that, in the charge transporting layer coating solution, the additive represented by Structural Formula (K) below was used instead of the additive represented by Structural Formula (IIa) above.

Structural Formula (K)

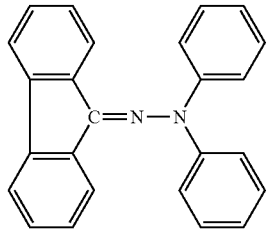

Comparative Example 8

Production of Electrophotographic Photoconductor

An electrophotographic photoconductor was produced in the same manner as in Example 1 except that, in the charge transporting layer coating solution, the additive represented by Structural Formula (L) below was used instead of the additive represented by Structural Formula (IIa) above.

Structural Formula (L)

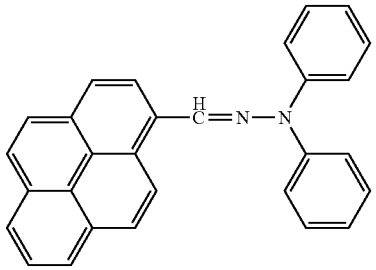

Comparative Example 9

Production of Electrophotographic Photoconductor

An electrophotographic photoconductor was produced in the same manner as in Example 1 except that, in the charge transporting layer coating solution, the additive represented by Structural Formula (M) below was used instead of the additive represented by Structural Formula (IIa) above.

Structural Formula (M)

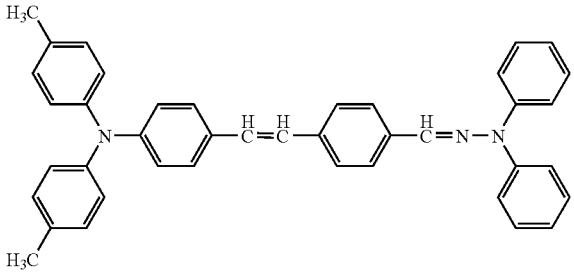

Next, characteristics of the electrophotographic photoconductors produced in Examples 1 to 13 and Comparative Examples 1 to 9 were evaluated as described below. The results are shown in Table 1.

<Initial Potential Evaluation>

Electrophotographic properties of each electrophotographic photoconductor produced were evaluated under the following conditions, using a device (ELYSIA V, manufactured by Yamanashi Electronics Co., Ltd.) for evaluating an electrophotographic photoconductor.

The surface potential of each electrophotographic photoconductor, when charged with a discharge current adjusted by a scorotron charging method such that the photoconductor had a surface potential of −700 V at a temperature of 23° C. and a relative humidity of 50%, was defined as the charge potential (Vo); and the surface potential of the photoconductor, when charged and then exposed with an exposure energy amount of 0.18 μJ/cm$^2$ in semiconductor laser irradiation with a wavelength of 780 nm, was defined as the residual potential (VL).

<Evaluation of Potential after Light-induced Fatigue>

Each electrophotographic photoconductor was irradiated with light with an illuminance of 1,000 lx for 10 minutes, using a fluorescent lamp, then the charge potential (Vo) and the residual potential (VL) of the photoconductor were measured. For charge elimination, an LED (20 μW) with a wavelength of 660 nm was used. The drum rotational speed of the photoconductor was set at 150 rpm, and the period of time between laser irradiation and the measurement of the potentials (the period of time spent by the photoconductor in moving from the position where it was exposed to the position where the potentials were measured) was 0.06 seconds.

<Evaluation of Image with Real Printer (Evaluation with Two-by-Two Image)>

Each photoconductor which was in the initial state and each photoconductor having undergone the test for light-induced fatigue were installed in a color printer (CX220, manufactured by Ricoh Company, Ltd.), then two-by-two images were output in a normal temperature environment (temperature: 23° C., relative humidity: 50%), and the difference (ΔID) in image density between an image formed in the initial state and an image formed after the test for light-induced fatigue, represented by the following equation, was measured using a Macbeth densitometer.

ΔID=ID (image density) in initial state−ID (image density) after test for light induced fatigue <Measurement of Absorbance>

The additive represented by Structural Formula (IIa) above, the additive represented by Structural Formula (IIb) above, the additive represented by Structural Formula (IId) above, the additive represented by Structural Formula (IIe) above, the additive represented by Structural Formula (IIf) above, the additive represented by Structural Formula (K) above, the additive represented by Structural Formula (L) above, the additive represented by Structural Formula (M) above, the additive C.I. Solvent Yellow 33 and the additive C.I. Disperse Orange 3 were prepared so as to weigh 0.5 mg each, using a scale, and these additives were each dissolved in 100 mL of tetrahydrofuran. The solutions were measured for absorbance in the wavelength range of 250 nm to 800 nm, using a visible ultraviolet spectrophotometer (UV-2450, manufactured by SHIMADZU CORPORATION). The maximum absorption wavelength λmax of each additive was calculated from the obtained absorbance waveforms of the additives. The absorbance waveforms of the additive represented by Structural Formula (IIa) above, the additive represented by Structural Formula (IIe) above, the additive C.I. Solvent Yellow 33, and the additive represented by Structural Formula (K) above are shown in FIGS. 5, 6, 7 and 8 respectively as typical examples.

TABLE 1

| | Charge potential Vo (−V) | | Residual potential VL (−V) | | | | |
|---|---|---|---|---|---|---|---|
| | Initial | After light-induced fatigue | Initial | After light-induced fatigue | ΔID | Additive | λmax of additive (nm) |
| Ex. 1 | 700 | 690 | 72 | 62 | 0.02 | (IIa) | 355 |
| Ex. 2 | 700 | 682 | 74 | 63 | 0.02 | (IIa) | 355 |
| Ex. 3 | 700 | 683 | 73 | 64 | 0.02 | (IIa) | 355 |
| Ex. 4 | 700 | 682 | 75 | 65 | 0.02 | (IIa) | 355 |
| Ex. 5 | 700 | 682 | 74 | 63 | 0.02 | (IIa) | 355 |
| Ex. 6 | 700 | 678 | 70 | 57 | 0.02 | (IIa) | 355 |
| Ex. 7 | 700 | 683 | 80 | 74 | 0.01 | (IIa) | 355 |
| Ex. 8 | 700 | 687 | 75 | 63 | 0.02 | (IIb) | 348 |
| Ex. 9 | 700 | 684 | 76 | 62 | 0.02 | (IIc) | 348 |
| Ex. 10 | 700 | 685 | 73 | 66 | 0.02 | (IId) | 344 |
| Ex. 11 | 700 | 683 | 75 | 63 | 0.02 | (IIe) | 348 |

TABLE 1-continued

| | Charge potential Vo (−V) | | Residual potential VL (−V) | | | | |
|---|---|---|---|---|---|---|---|
| | Initial | After light-induced fatigue | Initial | After light-induced fatigue | ΔID | Additive | λmax of additive (nm) |
| Ex. 12 | 700 | 685 | 74 | 62 | 0.02 | (IIf) | 344 |
| Ex. 13 | 700 | 687 | 78 | 69 | 0.02 | (IIa) | 355 |
| Comp. Ex. 1 | 700 | 650 | 170 | 150 | 0.04 | (IIa) | 355 |
| Comp. Ex. 2 | 700 | 650 | 150 | 140 | 0.04 | (IIa) | 355 |
| Comp. Ex. 3 | 700 | 630 | 70 | 38 | 0.07 | Not used | — |
| Comp. Ex. 4 | 700 | 670 | 72 | 40 | 0.06 | Not used | — |
| Comp. Ex. 5 | 700 | 670 | 80 | 53 | 0.05 | C.I. Solvent Yellow 33 | 420 |
| Comp. Ex. 6 | 700 | 670 | 78 | 55 | 0.04 | C.I. Disperse Orange 3 | 444 |
| Comp. Ex. 7 | 700 | 670 | 82 | 50 | 0.05 | (K) | 425 |
| Comp. Ex. 8 | 700 | 670 | 110 | 85 | 0.04 | (L) | 405 |
| Comp. Ex. 9 | 700 | 665 | 125 | 100 | 0.04 | (M) | 402 |

The results shown in Table 1 demonstrate that Examples were superior to Comparative Examples in that the potentials Vo and VL varied to a smaller extent between the initial state and the state after the light-induced fatigue. Also, higher responsiveness could be obtained as the value of VL became smaller. ΔID numerically represents the extent of the decrease in image density. When the value of ΔID was less than 0.03, formation of images with favorable image density could be maintained. When the value of ΔID was 0.03 or greater, images changed greatly in image density and were therefore not suitable for practical use.

In Examples 1 to 13, the addition of the charge transporting materials represented by General Formula (I) above and the additives represented by General Formula (II) above to the photosensitive layers made it possible to obtain electrophotographic photoconductors which were excellent in responsiveness and resistance to light-induced fatigue and thus superior in charge potential, residual potential and image density variation. Example 6 was a case where the amount of the additive represented by Structural Formula (IIa) above was small, and the electrophotographic photoconductor of Example 6 was slightly inferior to that of Example 1 in the variations of charge potential and residual potential; however, the difference in density between images was such that the images could be put to practical use. Example 7 was a case where the amount of the additive represented by Structural Formula (IIa) above was large, and the electrophotographic photoconductor of Example 7 was somewhat high in residual potential VL but was at the same level as that of Example 1 in terms of image density.

In Comparative Examples 1 and 2, electrophotographic photoconductors were produced using different charge transporting materials; the photoconductors were high in residual potential VL, and thus it was hardly possible to meet the demands for highly-sensitive, highly-responsive photoconductors. Comparative Example 3 was a case where a photoconductor was produced without adding the additive represented by Structural Formula (IIa) above, and Comparative Example 4 was a case where a photoconductor was produced with the addition of the antioxidant represented by Structural Formula (F) above instead of the additive represented by Structural Formula (IIa) above; as to both these photoconductors, which did not include the additive represented by Structural Formula (IIa) above, the potentials Vo and VL measured after the light-induced fatigue were much lower than those measured in the initial state, and the values of ΔID were very large. Comparative Examples 5 to 9 were cases where photoconductors were produced, adding different additives to the photosensitive layers; some of these photoconductors increased in residual potential VL; regarding the values of ΔID, these photoconductors were smaller in ΔID than the photoconductor of Comparative Example 3 but still not satisfactory in terms of their practical use, so that the results concerning these photoconductors were inferior to those concerning the photoconductors of Examples 1 to 13.

Regarding the photoconductors of Examples, the maximum absorption wavelength λmax ranged between 300 nm and 370 nm, and thus the photoconductors were not problematic in terms of both potential characteristics and image characteristics. Regarding the photoconductors of Comparative Examples 5 to 9, the maximum absorption wavelength λmax was outside the range of 300 nm to 370 nm.

The above-mentioned explanations prove that the electrophotographic photoconductors in which the charge transporting layers contained the respective charge transporting materials represented by General Formula (I) above and the respective additives represented by General Formula (II) above were highly responsive and had improved resistance to light-induced fatigue.

The electrophotographic photoconductor of the present invention can adapt to reduction in the diameter of the photoconductor and a process with high circumferential speed, caused by miniaturization and/or increase in the speed of an image forming apparatus, and is superior in light resistance. Hence, the electrophotographic photoconductor can be widely used, for example, in a laser printer and a direct digital platemaker, and in a full-color copier, a full-color laser printer and a full-color facsimile for plain paper which use a direct/indirect electrophotographic multicolor image developing method.

What is claimed is:

1. An electrophotographic photoconductor comprising:

a substrate;

a charge generating layer; and a charge transporting layer, the charge generating layer and the charge transporting layer being disposed over the substrate, wherein the charge transporting layer contains a charge transporting material represented by General Formula (I) below, an additive represented by General Formula (II) below and a binder resin prepared by mixing a polycarbonate resin represented by General Formula (III) below with a polycarbonate copolymer resin represented by a combination of Structural Formulae (A), (B) and (C) below:

General Formula (I)

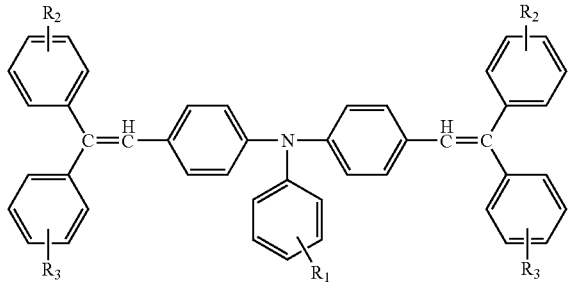

where $R^1$, $R^2$ and $R^3$ each independently denote any one of a hydrogen atom, a halogen atom, an alkyl group which may contain a substituent, and an alkoxy group which may contain a substituent, General Formula (II)

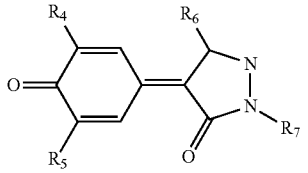

General Formula (III)

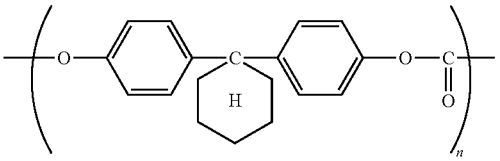

Structural Formula (A)

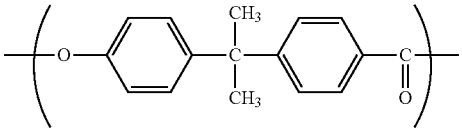

Structural Formula (B)

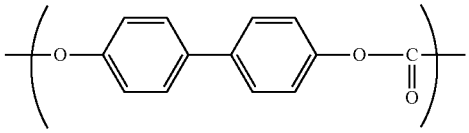

Structural Formula (C)

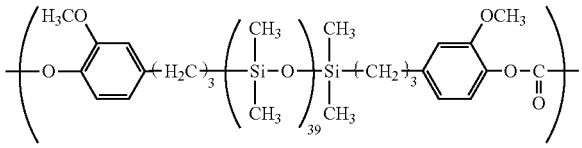

where $R^4$ and $R^5$ each denote a tertiary butyl group, and $R^6$ and R7 each independently denote one of an alkyl group which may contain a substituent, and an aryl group which may contain a substituent, and where n denotes the number of times the repeat unit is repeated such that the one of the polycarbonate resins has a viscosity average molecular weight of 20,000 to 50,000.

2. The electrophotographic photoconductor according to claim 1, wherein the additive represented by General Formula (II) has a maximum absorption wavelength in the range of 300 nm to 370 nm and does not have an absorption wavelength in the range of 730 nm to 800 nm.

3. The electrophotographic photoconductor according to claim 1, wherein the charge transporting material represented by General Formula (I) comprises the compound represented by Structural Formula (Ia) below:

Structural Formula (Ia)

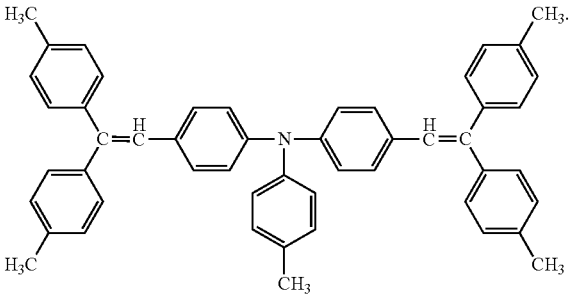

4. The electrophotographic photoconductor according to claim 1, wherein the charge transporting material represented by General Formula (I) comprises the compound represented by Structural Formula (Ib) below:

Structural Formula (Ib)

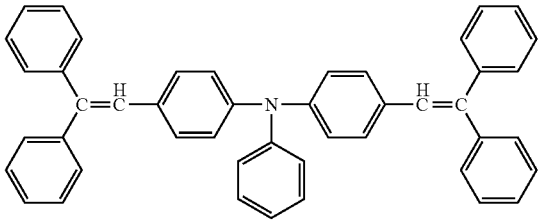

5. The electrophotographic photoconductor according to claim 1, wherein the charge transporting material represented by General Formula (I) comprises the compound represented by Structural Formula (Ie) below:

Structural Formula (Ic)

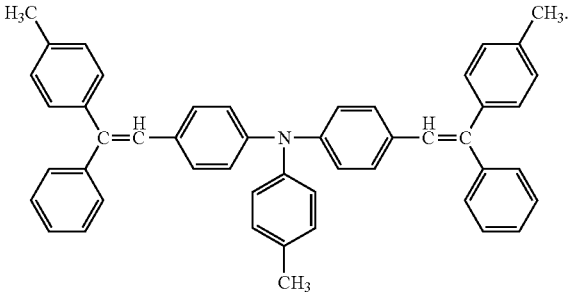

6. The electrophotographic photoconductor according to claim 1, wherein the charge transporting material represented by General Formula (I) comprises the compound represented by Structural Formula (Id) below:

Structural Formula (Id)

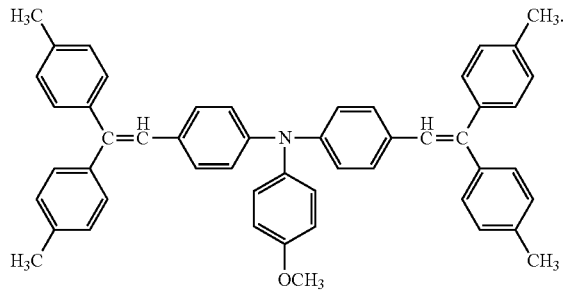

7. The electrophotographic photoconductor according to claim 1, wherein the charge transporting material represented by General Formula (I) comprises the compound represented by Structural Formula (Ie) below:

Structural Formula (Ie)

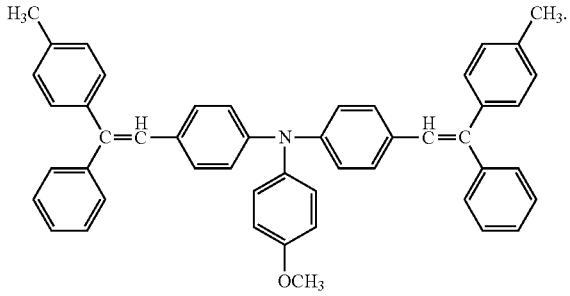

8. The electrophotographic photoconductor according to claim 1, wherein the additive represented by General Formula (II) comprises the compound represented by Structural Formula (IIa) below:

Structural Formula (IIa)

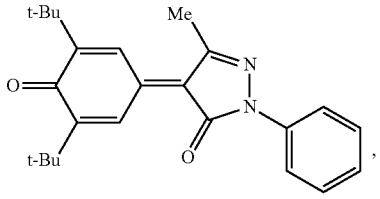

where t-Bu denotes a tertiary butyl group, and Me denotes a methyl group.

9. The electrophotographic photoconductor according to claim 1, wherein the additive represented by General Formula (II) comprises the compound represented by Structural Formula (IIb) below:

Structural Formula (IIb)

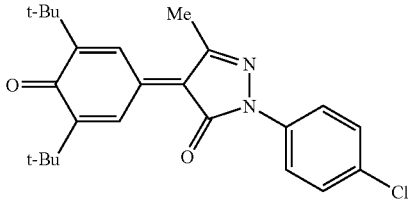

where t-Bu denotes a tertiary butyl group, and Me denotes a methyl group.

10. The electrophotographic photoconductor according to claim 1, wherein the additive represented by General Formula (II) comprises the compound represented by Structural Formula (IIc) below:

Structural Formula (IIc)

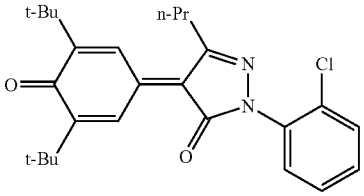

where t-Bu denotes a tertiary butyl group, and n-Pr denotes an n-propyl group.

11. The electrophotographic photoconductor according to claim 1, wherein the additive represented by General Formula (II) comprises the compound represented by Structural Formula (IId) below:

Structural Formula (IId)

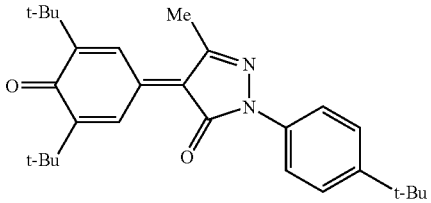

where t-Bu denotes a tertiary butyl group, and Me denotes a methyl group.

12. The electrophotographic photoconductor according to claim 1, wherein the additive represented by General Formula (II) comprises the compound represented by Structural Formula (IIe) below:

Structural Formula (IIe)

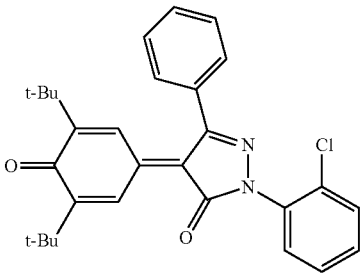

where t-Bu denotes a tertiary butyl group.

13. The electrophotographic photoconductor according to claim 1, wherein the additive represented by General Formula (II) comprises the compound represented by Structural Formula (IIf) below:

Structural Formula (IIf)

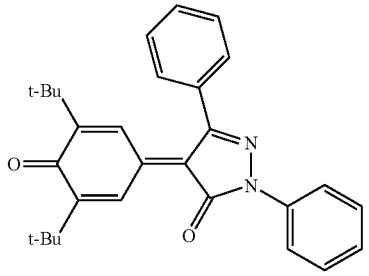

where t-Bu denotes a tertiary butyl group.

14. The electrophotographic photoconductor according to claim 1, wherein the charge transporting layer further contains a benzotriazole-based ultraviolet absorber.

15. The electrophotographic photoconductor according to claim 1, wherein the charge transporting layer further contains a phenolic antioxidant.

16. A process cartridge detachably mountable to a main body of an image forming apparatus, comprising:

an electrophotographic photoconductor; and a developing unit configured to develop a latent electrostatic image, formed on the electrophotographic photoconductor, with a toner so as to form a visible image, wherein the electrophotographic photoconductor comprises a substrate, a charge generating layer and a charge transporting layer, the charge generating layer and the charge transporting layer being disposed over the substrate, and wherein the charge transporting layer contains a charge transporting material represented by General Formula (I) below, an additive represented by General Formula (II) below and a binder resin prepared by mixing a polycarbonate resin represented by General Formula (III) below with a polycarbonate copolymer resin represented by a combination of Structural Formulae (A), (B) and (C) below:

General Formula (I)

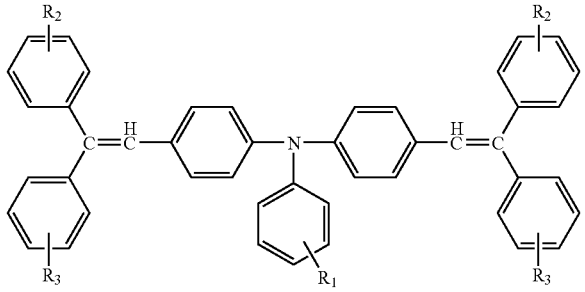

where $R^1$, $R^2$ and $R^3$ each independently denote anyone of a hydrogen atom, a halogen atom, an alkyl group which may contain a substituent, and an alkoxy group which may contain a substituent, General Formula (II)

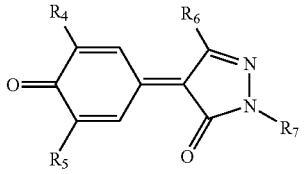

General Formula (III)

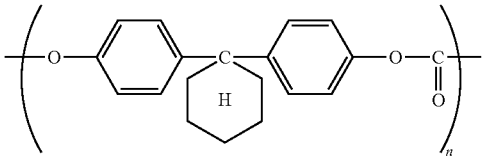

Structural Formula (A)

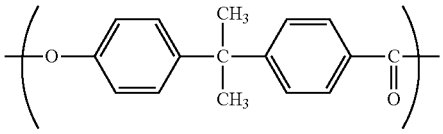

Structural Formula (B)

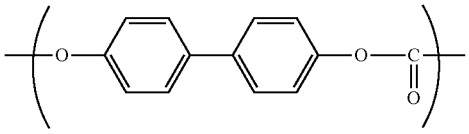

Structural Formula (C)

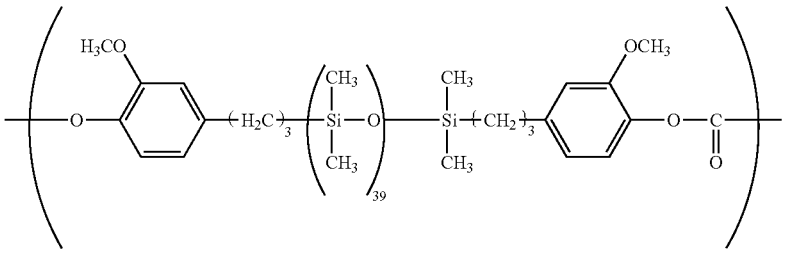

where $R^4$ and $R^5$ each denote a tertiary butyl group, and $R^6$ and $R^7$ each independently denote one of an alkyl group which may contain a substituent, and an aryl group which may contain a substituent, and where n denotes the number of times the repeat unit is repeated such that the one of the of carbonate resins has a viscosity average molecular weight of 20,000 to 50,000.

17. An image forming apparatus comprising:

an electrophotographic photoconductor;

a latent electrostatic image forming unit configured to form a latent electrostatic image on the electrophotographic photoconductor;

a developing unit configured to develop the latent electrostatic image with a toner so as to form a visible image;

a transfer unit configured to transfer the visible image onto recording medium; and a fixing unit configured to fix the visible image transferred onto the recording medium, wherein the electrophotographic photoconductor comprises a substrate, a charge generating layer and a charge transporting layer, the charge generating layer and the charge transporting layer being disposed over the substrate, and wherein the charge transporting layer contains a charge transporting material represented by General Formula (I) below, an additive represented by General Formula (II) below and a binder resin prepared by mixing a polycarbonate resin represented by General Formula below with a polycarbonate copolymer resin represented by a combination of Structural Formulae (A), (B) and (C) below:

General Formula (I)

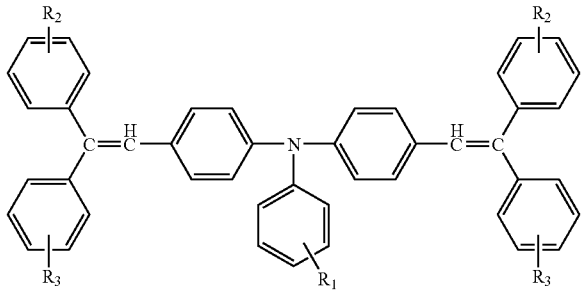

where $R^1$, $R^2$ and $R^3$ each independently denote anyone of a hydrogen atom, a halogen atom, an alkyl group which may contain a substituent, and an alkoxy group which may contain a substituent, General Formula (II)

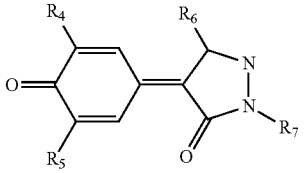

General Formula (III)

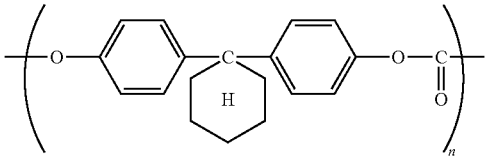

Structural Formula (A)

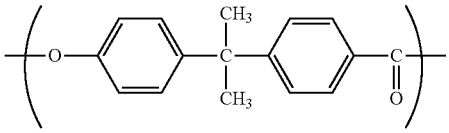

Structural Formula (B)

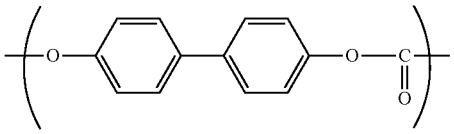

Structural Formula (C)

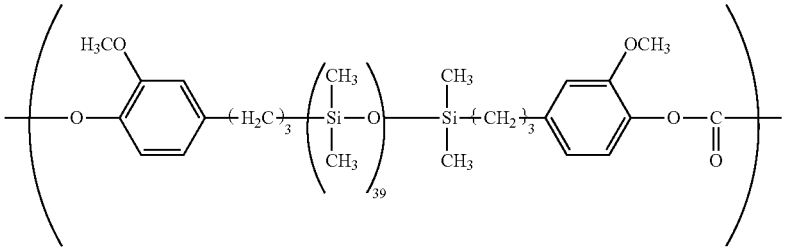

where $R^4$ and $R^5$ each denote a tertiary butyl group, and $R^6$ and $R^7$ each independently denote one of an alkyl group which may contain a substituent, and an aryl group which may contain a substituent, where n denotes the number of times the repeat unit is repeated such that the one of the polycarbonate resins has a viscosity average molecular weight of 20,000 to 50,000.

* * * * *